US005708719A

United States Patent [19]

Greenberger et al.

[11] Patent Number: 5,708,719

[45] Date of Patent: Jan. 13, 1998

[54] IN-HOME THEATER SURROUND SOUND SPEAKER SYSTEM

[75] Inventors: Hal P. Greenberger, Hopedale; William F. Clack; Jerome E. Ruzicka, both of Stow, all of Mass.

[73] Assignee: REP Investment Limited Liability Company, Grand Rapids, Mich.

[21] Appl. No.: 525,364

[22] Filed: Sep. 7, 1995

[51] Int. Cl.[6] ..... H04R 5/00

[52] U.S. Cl. ..... 381/18; 381/27

[58] Field of Search ..... 381/17, 18, 24, 381/27, 14, 19

[56] References Cited

U.S. PATENT DOCUMENTS

| | | |
|---|---|---|
| Re. 29,171 | 4/1977 | Takahashi . |
| Re. 31,288 | 5/1983 | Bose . |
| 1,969,704 | 8/1934 | D'Alton . |
| 3,697,692 | 10/1972 | Hafler . |
| 3,745,254 | 7/1973 | Ohta et al. . |
| 3,757,047 | 9/1973 | Ito et al. . |
| 3,761,631 | 9/1973 | Ito et al. . |
| 3,777,076 | 12/1973 | Takahashi . |
| 3,819,005 | 6/1974 | Westlund . |
| 3,885,101 | 5/1975 | Ito et al. . |
| 3,892,917 | 7/1975 | Sotome . |
| 3,906,156 | 9/1975 | Cooper . |
| 3,919,478 | 11/1975 | Schott . |
| 3,970,788 | 7/1976 | Cooper . |
| 3,997,725 | 12/1976 | Gerzon . |
| 4,006,306 | 2/1977 | Driscoll . |
| 4,006,311 | 2/1977 | Carlsson . |
| 4,015,089 | 3/1977 | Ishii et al. . |
| 4,024,344 | 5/1977 | Dolby et al. . |
| 4,039,755 | 8/1977 | Berkovitz . |
| 4,051,919 | 10/1977 | Buettner . |
| 4,058,675 | 11/1977 | Kobayashi et al. . |
| 4,069,394 | 1/1978 | Doi et al. . |
| 4,074,083 | 2/1978 | Berkovitz et al. . |
| 4,086,433 | 4/1978 | Gerzo . |
| 4,095,049 | 6/1978 | Gerzon . |
| 4,097,688 | 6/1978 | Ochi . |
| 4,132,859 | 1/1979 | Ranga . |
| 4,135,975 | 1/1979 | Barker, III . |
| 4,142,603 | 3/1979 | Johnson . |
| 4,146,744 | 3/1979 | Veranth . |
| 4,146,745 | 3/1979 | Froeschle et al. . |
| 4,149,031 | 4/1979 | Cooper . |

(List continued on next page.)

*Primary Examiner*—Curtis Kuntz
*Assistant Examiner*—Vivian Chang
*Attorney, Agent, or Firm*—Harness, Dickey & Pierce, P.L.C.

[57] ABSTRACT

An apparatus for realistically reproducing sound, particularly for sound based on a stereophonic signal having dialog and effects and associated with an accompanying video image. The apparatus includes a front speaker located in proximity to the video image for providing acoustic output based upon a summation signal of the component left and right (L+R) channels of the audio signal. A rear speaker located to the rear of the viewing area provides acoustic output based upon a difference signal, (L–R) or (R–L), between the left and right channels. Left and right speakers located to the respective left and right sides of the viewing area output audio based upon the respective left or right channels. The left and right channels speakers reproduce in one embodiment the respective left and right channels of the audio signal and in a second embodiment reproduce a difference signal, (L–R) or (R–L). Output to the left and right speakers is band limited to substantially filter out frequency components below a predetermined threshold. A bass speaker may also be provided to output the low frequency components of a (L+R) summation signal. The (L+R) summation signal input assists in localizing dialog to the front speaker, in proximity to the video image. The (L–R) or (R–L) difference signal substantially removes dialog sound so that the side and rear speaker output primarily comprises sonic ambience and surround sound effects. Band limiting the left and right speakers further assists in localizing dialog to the video image.

35 Claims, 8 Drawing Sheets

U.S. PATENT DOCUMENTS 4,154,979 5/1979 Barker .
4,179,669 12/1979 Dodson et al. .
4,182,931 1/1980 Kenner .
4,186,273 1/1980 Dodson .
4,190,739 2/1980 Torffield .
4,218,583 8/1980 Poulo .
4,236,039 11/1980 Cooper .
4,266,092 5/1981 Barker, III .
4,282,605 8/1981 Bose .
4,283,606 8/1981 Buck .
4,303,800 12/1981 DeFreitas .
4,332,979 6/1982 Fischer .
4,348,549 9/1982 Berlant .
4,355,203 10/1982 Cohen .
4,357,490 11/1982 Dickey .
4,404,427 9/1983 Blackmer .
4,410,063 10/1983 Yasue et al. .
4,414,430 11/1983 Gerzon .
4,443,889 4/1984 Norgaard .
4,472,834 9/1984 Yamamuro et al. .
4,490,843 12/1984 Bose et al. .
4,497,064 1/1985 Polk .
4,549,631 10/1985 Bose .
4,569,074 2/1986 Polk .
4,580,654 4/1986 Hale .
4,589,129 5/1986 Blackmer et al. .
4,593,404 6/1986 Bolin .
4,594,729 6/1986 Weingartner .
4,596,034 6/1986 Moncrieff .
4,612,663 9/1986 Holbrook et al. .
4,621,708 11/1986 Potter .
4,628,528 12/1986 Bose et al. .
4,630,298 12/1986 Polk et al. ..... 381/24
4,638,505 1/1987 Polk et al. .
4,650,031 3/1987 Yamamoto .
4,691,362 9/1987 Eberbach .
4,703,502 10/1987 Kasai et al. .
4,723,289 2/1988 Schreiber et al. .
4,739,514 4/1988 Short et al. .
4,748,669 5/1988 Klayman .
4,800,983 1/1989 Geren .
4,807,217 2/1989 Ide .
4,815,133 3/1989 Hibino .
4,819,269 4/1989 Klayman .
4,836,329 6/1989 Klayman .
4,837,825 6/1989 Shivers .
4,850,452 7/1989 Wolcott .
4,862,502 8/1989 Griesinger .
4,866,774 9/1989 Klayman .
4,875,546 10/1989 Krnan .
4,888,804 12/1989 Gefvert .
4,907,671 3/1990 Wiley .
4,932,060 6/1990 Schreiber .
4,944,019 7/1990 Watanabe .
4,968,154 11/1990 Baeg .
4,978,926 12/1990 Zerod et al. .
5,025,885 6/1991 Froeschle .
5,027,403 6/1991 Short et al. .
5,033,577 7/1991 Veranth .
5,034,984 7/1991 Bose .
5,036,946 8/1991 Yoshino .
5,043,970 8/1991 Holman .
5,046,106 9/1991 Liebel et al. .
5,092,424 3/1992 Schreiber et al. .
5,111,509 5/1992 Takeuchi et al. .
5,115,882 5/1992 Woody .
5,117,459 5/1992 McShane .
5,129,006 7/1992 Hill et al. .
5,131,052 7/1992 Hill et al. .
5,136,650 8/1992 Griesinger .
5,137,110 8/1992 Bedard, Jr. et al. .
5,147,986 9/1992 Cockrum et al. .
5,161,197 11/1992 Griesinger .
5,177,329 1/1993 Klayman .
5,181,247 1/1993 Holl .
5,189,706 2/1993 Saeki .
5,216,209 6/1993 Holdaway .
5,250,763 10/1993 Brown .
5,268,539 12/1993 Ono .
5,386,473 1/1995 Harrison .

IN-HOME THEATER SURROUND SOUND SPEAKER SYSTEM

BACKGROUND OF THE INVENTION

1. Technical Field

This invention relates generally to the reproduction of stereophonic sound, and, more particularly to the reproduction of stereophonic sound associated with a video image so that dialog is localized to the video image and ambience and sound effects are reproduced in a manner that immerses the listener in a realistic, three-dimensional sound field.

2. Discussion

In the past, numerous monophonic and stereophonic sound systems have been developed in an attempt to achieve high fidelity sound reproduction. Initial efforts restricted the concept of high fidelity to reproducing monophonic audio signals. These early efforts focused on producing a speaker enclosure meeting performance criteria defined by measurable acoustic characteristics such as frequency response, distortion, and dynamic range. The speakers included an enclosure containing one or a number of acoustic transducers and crossover networks intended to reproduce the full frequency range of audibility. As an example of such a multiple transducer and crossover configuration, a three-way speaker design includes a woofer transducer to reproduce low frequencies, a mid-range transducer to reproduce middle frequencies, and a tweeter transducer to reproduce high frequencies.

The typical crossover network described above blends the acoustic output of speaker transducers to achieve good tonal balance characterized by a smooth transition in acoustic output from one transducer to another. One way to accomplish this is a symmetrical crossover network that function as a filter to assure the response drop-off of one transducer as frequency increases through the transition region is a mirror image of the response increase of a companion transducer reproducing the adjacent higher frequency band of sound. Proper implementation of this design approach requires that the combination of transducers and crossover networks do not introduce audible artifact (an unnatural sound quality) resulting from frequency response irregularities or phase cancellation effects that potentially result from housing a multiplicity of transducers in one speaker enclosure.

The early attempts at high fidelity through monophonic audio signals and three way crossover networks eventually gave way to stereophonic sound reproduction. Early stereophonic systems employed a pair of identical, spatially distributed high-fidelity speakers to reproduce two-channels of audio signal. This spatial distribution of two speaker enclosures is fundamental to the concept of stereo sound reproduction. A stereo image results when the acoustic output from the pair of speakers fuses into a stereo image perceived as a horizontal panorama of sound. This panorama of sound creates for the listener a stereo sound image that spans the space between the two speaker locations. A proper stereo perspective results for a listener positioned along an axis between the two speakers and perpendicular to the plane of the speakers.

Most speakers employed in stereophonic systems project sound in a direct path from the speaker to the listener, referred to as direct-radiation. In an attempt to broaden the stereo image, designers have employed speaker pairs which radiate a combination of direct and reflected sound. Such a configuration expands the stereo image beyond the space between the two speakers.

Some more contemporary stereophonic sound system designs utilize three-piece sub-satellite speaker systems in which a combination of a sub-woofer bass unit and a pair of satellite speakers replaces the pair of conventional full-range speaker enclosures described above. In such three-piece speaker systems, the satellite speakers reproduce a broad spectrum of mid and high frequency sounds, while the bass unit reproduces only very low frequency sounds. Restricting bass reproduction to the sub-woofer unit allows the satellite speakers to be of relatively small size compared to traditionally large stereo speaker boxes, whose large size is dictated by the large transducers and enclosures needed to achieve good bass response. Many consumers prefer this smaller satellite speaker arrangement over the more traditional pair of full-range speaker enclosures. The bass unit can be placed out of sight, and the satellite speakers are more easily blended in with the room decor. However, other consumers still view these somewhat smaller satellite speaker boxes as unsightly and difficult to incorporate in the home setting in an unobtrusive manner.

Despite the improvements in the overall sound quality provided by even the most sophisticated systems, whether a pair of stereo speakers or a three-piece sub-satellite system, many consumers believe contemporary sound systems lack the sense of sonic realism associated with live sound. Each sound reproduction system, while meeting quantitative acoustic performance criteria relative to frequency response, distortion, and dynamic range, can subjectively evoke a wide range of listener perceptions of sonic realism from a qualitative point of view. Some systems determined to sound more realistic have also been found to create a sense of spaciousness in the reproduced sound. This determination has provided the basis for extensive developments in the field of acoustics in order to achieve an enhanced spatial quality to reproduced sound, while avoiding the introduction of sonic artifact that would detract from the overall sonic experience.

The three-piece sub-satellite speaker system described above extends the concept of spatially distributing speaker components such as a stereo pair of speakers. The concept can be yet further extended by spatially distributing a substantial number of point sources for reproducing sound in a listening environment to further increase the perceived spaciousness. While adding a multiplicity of spatially distributed point sources of sound can increase the perception of spaciousness, it also can produce an exaggerated, overblown spatial presentation that lacks realism. Such unnatural sound reproduction often causes the listener to experience acoustic fatigue. Thus, enhanced spaciousness must balance with the perceived acoustic realism of the resulting sound field in order to completely satisfy the listener.

This balance is particularly important in home theater sound systems where the acoustic requirements for this application differ from those for sound reproduction of stereo music. The key objectives for a home-theater sound system are to (1) establish a convincing surround sound acoustic atmosphere based on ambience and sound effect audio signals captured in the soundtrack; (2) maintain a stereo image panorama of sound in front of the viewer; and (3) reproduce dialog that remains localized to the video screen for all viewers in the room. In essence, satisfactory acoustic performance results when the listener is immersed in a sound field having a three-dimensional spatial quality perceived as authentic in relation to the visual presentation on the video screen.

Initial attempts to produce home theater sound included placing a pair of traditional speakers on either side of a centrally located video display. Such systems improved upon the sound of speakers included within the typical television set. However, the performance of such systems was determined to be unacceptable in the marketplace for at least two reasons. First, listeners located off the center line between the two speakers will not localize dialog to the screen (i.e., perceive the dialog to be solely coming from the screen). Dialog is typically recorded equally in both the left and right channels signals. Localization of dialog will be a point equidistant between the two speakers for a listener on the centerline between the speakers. As a listener moves off the center line, he will move closer to one speaker and farther away from the other. Localization of dialog will shift to the direction from which the first arriving signal originates. This will be the closest speaker. Dialog collapses to the near speaker as a listener moves off axis. The localization of dialog will be displaced from the location of the video image for off axis listeners, and the illusion that the characters on screen are actually speaking for off axis listeners will be destroyed. Second, a pair of stereo speakers located on either side of the visual display confines the sound field to the space in front of the listener, in the plane of the speakers. There is, thus, no sense of immersion—a sense that sound events occur to the side or behind the listener as well as in front of the listener.

Many systems have been designed in an attempt to remedy these deficiencies. For example, U.S. Pat. No. 3,697,692, issued to Hafler, discusses using ambience-recovery technology. Hafler utilized the fact that surround sound information resides in virtually all stereo audio signals, whether music recordings or the soundtrack of video program material, and can be recovered. Recovery results from obtaining the difference signal between the left and right channel (L–R) leaving substantially only the ambience portion of the signal. This left minus right (L–R) difference signal reproduced by speakers placed in the rear of the listening room provides the recovered surround sound information.

Another alternative early home-theater sound system added an additional center channel to reproduce a left plus right (L+R) sum signal to improve the quality of dialog sound reproduction. The center channel was combined with rear surround speakers that reproduce a left minus right (L–R) difference signal, similar to the ambience recovery speakers described above. An example of such a system has been developed by Dolby Laboratories under the name DOLBY SURROUND.

The center speaker for reproducing the (L+R) signal, as embodied in DOLBY SURROUND systems, improved upon the desirable localization effect of dialog for off-axis listeners. However, the (L+R) center channel reproduction did not completely solve the problem of displacement between the auditory and visual images for off axis listeners. Those systems still suffer from localization errors for dialog (and other signals encoded in the sum signal) because passive decoding schemes such as DOLBY SURROUND are only capable of achieving a maximum adjacent channel separation of 3 dB (where adjacent channels are defined as center and right, center and left, left and surround, right and surround). A 3 dB difference in level between dialog in the center channel and dialog in the left and right channels is not sufficient to confine localization to the location of the center channel speaker for all listening positions throughout a typical listening room. Localization still shifts to the near speaker for off axis listeners. Having dialog collapse to the near speaker is common to all prior art passive decoder systems.

In an alternative approach to DOLBY SURROUND systems, a T-configuration arrangement proposed by U.S. Pat. No. 4,612,663, issued to Holbrook, provides surround sound by passively decoding the stereo signals. The T-configuration includes left and right speakers reproducing the respective left and right signals, a third speaker reproducing the difference (L–R) signal positioned midway between and in the plane of the left and right speakers, and a fourth speaker reproducing the difference signal positioned behind the listener. However, this approach fails to maintain a rational sonic image in situations where the stereo signal temporarily has predominantly left or right channel energy and also fails to prevent the perception of dialog emanating from the near left or near right speaker.

Another system using (L–R) and (R–L) difference signals may be found in U.S. Pat. No. 5,027,403, issued to Short et al. Short discusses using forward facing left and right channels to provide sound output in the direction of the listener. Short also discusses directing (L+R) bass signals rearwardly from the general plane of the video viewing area. Short further discusses directing (L–R) and (R–L) signals rearwardly or sidewardly from the general vicinity of the video image. However, Short suffers from the disadvantage that all sounds emanating from the speakers emanate from the video image. Such substantially planar sound radiation does not fully provide the ambience and surround sound effect.

Another example of a system having speakers arranged in a generally planar configuration can be found in U.S. Pat. No. 4,497,064, issued to Polk. Polk also discusses arranging main left and right speakers and additional sub-speakers, disposed in proximity to the main speakers, to provide the listener with an expanded acoustic image during stereophonic sound reproduction. However, Polk maintains specific, limiting system requirements, including that the speakers be equidistant from the listener in order to assure the arrival of sound at the listener within a predetermined time period. Polk further discusses high pass filtering an inverted version of a main speaker signal for output from the opposite side sub-speaker. The high pass filtering cancels the opposite side main speaker component which would otherwise reach the ear of the listener on the side which is filtered. However, the high pass filters are not directed to cancelling low frequency components to maintain localization of voice information to a video image. Polk also specifically requires that all system speakers remain located in substantially the same plane and radiate in the direction of the listener. The system of Polk will also not be able to maintain localization of program material equally recorded in the left and right channels to the area centered between the two speakers for off axis listeners. Localization of such signals will shift toward the near speaker for off axis listeners.

Examples of non-planar speaker configurations include U.S Pat. No. 4,443,889, issued to Norgaard. Norgaard discusses the use of a left front speaker and a right front speaker to reproduce the respective left and right channel stereo signals. Norgaard also discusses the use of a (L–R) difference signal through a rear speaker to create an ambience signal. However, among other things Norgaard does not consider combining a (L+R) summation signal through a center speaker to better localize dialog to the video image.

U.S. Pat. No. 5,181,247, issued to Holl discusses similar concepts regarding the use of (L–R) and (R–L) difference signals. However, Holl does not teach the use of a single speaker to output a (L+R) summation signal. Nor does Holl suggest bandlimiting the signal input to the ambience speakers.

U.S. Pat. No. 4,819,269, issued to Klayman, discusses radiating sound based on a summation signal in a limited dispersion pattern and radiating sound based on a difference signal in a wide dispersion pattern. The radiated signals combine acoustically with the intent of improving the stereo sound in the listening area. However, Klayman specifically requires specialized, wide dispersion horns or arrays of multiple transducers to achieve the desired effect described. Further, Klayman does not discuss excluding the primary frequency range of vocal energy from the output of any of the speakers to better localize dialog to the center speaker.

Other surround sound type systems use complex signal processing in an attempt to improve the apparent separation between each of the left, center, right, and surround channels. The most common system of this type in use today is the DOLBY PRO-LOGIC decoding system. This system improves upon solutions to the basic problems of many prior art passive decoding systems previously described. Active electronic circuits are used to decode matrix-encoded audio signals, introduce time delays, and accomplish steering between channels through auto-gain control circuitry. However, the improved performance requires a substantially greater expense because DOLBY PRO-LOGIC requires a minimum of four separate amplification channels.

Further, by their very nature, active electronic signal processing systems potentially introduce sonic artifact (an unnatural sound quality that can destroy the sense of realism) in their response. One such form of artifact in the DOLBY PRO-LOGIC system results from the active steering circuits that vary the amount of adjacent channel signal subtracted from a signal. For example, when dialog is present and it is desired for it to be localized to the center, the center channel signal is subtracted from the left and right channel signals to remove dialog energy from these channels. This variable subtraction is dynamically varying channel separation to maintain primary localization in a particular direction. Listeners frequently can hear the ambience (which creates atmosphere in the audio-video presentation) come and go as dialog enters or leaves the scene. The shrinking down and growing back of the ambience that accompanies the introduction and cessation of dialog distracts the listener and proves to be a clear disadvantage of this particular active electronics approach to home-theater sound reproduction.

Another drawback to the DOLBY PRO-LOGIC is that it only works properly with encoded program material. Unencoded material, or material that has been degraded in some way can confuse the logic circuits and cause strange, extreme spatial effects to occur when the decoder steers localization in a way that was not intended. Another major disadvantage of the active DOLBY PRO-LOGIC decoding system includes its high cost to the consumer and its inherent complexity that makes it difficult for the consumer to install and use the system properly.

More recently, there has been a return to attempt to provide less complex, inexpensive, passive surround sound systems. An example of such systems is described in U.S. Pat. No. 5,386,473, issued to Harrison. Harrison is directed to the use of a transformer that passively decodes line level stereo television output signals that require further amplification to produce the high level signal necessary to drive speakers. The transformer receives input left and right channel signals and provides left front, right front, left rear (L–R), right rear (R–L), center (L+R), and sub-woofer channels. Harrison resorts to transforming low level signals specifically to solve perceived problems resulting from the use of speakers connected to high level amplifier outputs to obtain a surround sound effect. However, Harrison cites disadvantages in operating a passive surround sound system satisfactorily on high level signals. The present invention is directed specifically to using high level signals to provide surround sound while alleviating the problems mentioned regarding high level systems discussed in Harrison, such as the expense of high-powered components, balance problems, and the like.

Other recent attempts at passive decoding include the QD-1 Series II decoder manufactured by Dynaco. The QD-1 Series II decoder receives signals from the stereo amplifier. The decoder then produces four (or five) signals—two front speakers, two rear speakers, and an optional center channel speaker. A second, similar decoder is the HTS-1 Decoder manufactured by Chase Technologies. Similar to QD-1, the Chase Decoder receives signals from the amplifier and then generates signals for a pair of front and a pair of rear speakers. The Chase Decoder also produces a signal for an optional, amplified center channel speaker.

These latter two passive decoders suffer from two primary disadvantages. First, the resistor network used to produce a (L+R) signal for the center channel dissipates energy thus requiring a stereo amplifier or receiver of sufficiently high power to overcome this energy loss. It is preferable to provide a system in which all speakers of the system are driven by a relatively low-power amplifier, such as is found in a television or a portable boom-box wherein no power is wasted in signal summing resistor networks. In one of the previous systems, the center channel speaker must be powered in order to generate the desired function of maintaining dialog localization at the physical location of the center speaker. Second, because a certain amount of (L+R) signal is fed to the rear surround speakers, artifact can occur in terms of dialog emanating from the rear surround speaker thus disturbing the realism of the intended ambience effect.

Thus, there remains a need for a home theater surround sound speaker system which operates using relatively simple, passive electronics in order to limit its cost and thus provide a system having mass market appeal at a reasonable cost. Of particular importance in these systems is the desirability that they present a consistent ambient sound field while maintaining dialog localized to the video image for all positions in the listening and viewing area. The dialog and visual images also preferably coincide at the video image and preferably are not displaced from each other in a direction of a particular speaker.

In addition to the obvious desirability of a home theater surround sound system which provides all of the above-described benefits, a more practical logistical problem exists in home theater systems. Namely, as home theater systems continue to evolve, they typically require an ever increasing number of additional components. Such components often include active electronic controllers, numerous speakers connections, ancillary control modules, and separate audio system interconnects. This morass of components often confuses the average consumer during installation. Despite numerous attempts by manufacturers to make installation more user-friendly and to facilitate the installation procedure, many users experience difficulties in properly installing the system. The most recent attempts to facilitate the installation process have involved color coding the connections at the speaker and at the audio signal source in addition to labeling the connection jacks for the user to view, and have provided detailed and complete installation instructions. For many reasons, these measures have failed to provide the consumer with a sufficiently easy way to install home theater sound system correctly, and many consumers are faced with the expense of a professional installation.

Thus, it is further desirable to provide a home theater surround sound system which greatly facilitates installation so that the consumer may relatively quickly, easily, and correctly install and operate the system, thus, enhancing mass market appeal.

OBJECTS OF THE INVENTION

The present invention achieves numerous objectives based on the novel application of a variety of acoustic design principles and through a novel combination of adjacent channel separation and individual channel operating bandwidth.

It is an object of the present invention to create a realistic sound field to accompany video presentations that localizes dialog to the video screen for all listeners throughout the viewing area while maintaining a consistent, spacious three dimensional sound field.

It is a further object of the present invention to provide a low-cost sound reproduction speaker system that produces authentic movie-theater surround sound comparable or superior to that provided by complex and expensive active electronic multi-channel surround-sound matrix-decoding systems.

It is a further object of the present invention to passively decouple the reproduction of dialog and ambience audio signals to avoid ambience-instability artifact associated with active electronic signal processing and to ensure the presentation of a convincing integration of visual and sonic images.

It is a further object of the present invention to provide spacious sound reproduction of conventional audio signal sources, such as two-channel stereo or matrix-encoded stereo signals, without the need for auxiliary matrix decoding electronics.

It is a further object of the present invention to provide a speaker system that is relatively simple and straight-forward for the average consumer to install and operate, including the provision of mistake-free connection by the consumer in a relatively short period of time.

It is a further object of the present invention to provide a speaker system that connects easily and directly to a stereo television set without the need for an additional audio-video receiver or amplifier.

It is yet a further object of the present invention to provide movie-theater surround sound at normal home listening levels using the low wattage power amplifier, or equivalent, available in commercial stereo TV sets.

It is a further object of the present invention to provide a speaker system having an extraordinarily small size and operating principle that incorporates diminutive satellite speakers which can be placed unobtrusively in the home environment without affecting sonic performance.

SUMMARY OF THE INVENTION

In accordance with the principles of the present invention, a home theater surround sound speaker system reproduces in a novel manner the stereophonic audio portion of an audio/video presentation so that dialog is localized to the video image and the viewer is immersed in a sound field perceived as authentic in relation to the visual image.

In a first preferred embodiment of the present invention, the passive, unpowered speaker system includes a front speaker, a left speaker, a right speaker, and a rear speaker, each speaker receiving an electrical input signal and providing an acoustic output in accordance with the electrical input signal. The front speaker is located in proximity to the video image and provides an acoustic output in accordance with a left plus right (L+R) summation of the left and right channels of the stereophonic signal, so that dialog localizes to and coincides with the video image. The right and left speakers may be co-planar with the front speaker, but preferably are located between the viewer and the front speaker, and to the left and the right sides of the viewing area, respectively. The speakers provide acoustic output in accordance with the respective left and right stereophonic channels. The rear speaker is located to the rear of the viewing area and provides acoustic output in accordance with a left minus right (L–R) or right minus left (R–L) difference between the stereophonic channel signals. The difference signal substantially filters out dialog and provides the ambience and surround sound audio information. The left and right channel electrical signal inputs to the respective left and right speakers are band limited to substantially remove all frequency components below a predetermined threshold frequency. Band limiting insures that dialog is localized to the front speaker, as the filtering substantially removes signal energy in the speech signal range from the left and right channel signals being acoustically reproduced.

In a second preferred embodiment, the passive, unpowered speaker system includes a front speaker, a left speaker, a right speaker, and a rear speaker, each speaker receiving an electrical input signal and providing an acoustic output in accordance with the electrical input signal. The front speaker is located in proximity to the video image and provides an acoustic output in accordance with a left plus right (L+R) summation of the left and right channels of the stereophonic signal, so that dialog localizes to and coincides with the video image. The left speaker may be co-planar with the front speaker, but preferably is located between the viewer and the front speaker, and to the left side of the viewing area. The left speaker provides acoustic output in accordance with an electrical difference input signal, (L–R), for example. Similarly, the right speaker is preferably located between the viewer and the front speaker, and to the right side of the viewing area. The right speaker provides acoustic output in accordance with a difference signal, (R–L), for example. The rear speaker is located to the rear of the viewing area and provides acoustic output in accordance with at least one of a left minus right (L–R) or right minus left (R–L) difference between the stereophonic channel signals. Utilizing the difference signal substantially removes the dialog portion of the audio signal, thereby leaving the ambient sounds in the difference signals. In this second preferred embodiment, the difference signals input to the respective left and right speakers may also be optionally band limited to substantially remove all frequency components below a predetermined threshold frequency. Band limiting the difference signals substantially removes the low frequency components in the difference signal so that the difference signal may be reproduced using exceedingly small, compact speakers.

In a third preferred embodiment, the powered speaker system includes a front speaker, a left speaker, a right speaker, and a rear speaker, each speaker receiving an electrical input signal and providing an acoustic output in accordance with the electrical input signal. Active electronics preprocess and amplifies the left and right channels of the stereophonic signal to provide a left plus right (L+R) summation signal and a difference signal, (L–R), for example. The resultant summation and difference signals drive the individual speakers of the speaker system. The front speaker is located in proximity to the video image and provides an acoustic output in accordance with the summation signal, so that dialog localizes to and coincides with the video image. The left speaker is located to the left side of the viewing area and provides acoustic output in accordance with the difference signal, (L–R), for example. The right speaker is located to the right side of the viewing area, and provides acoustic output in accordance with the difference signal, (R–L), for example. The rear speaker is located to the rear of the viewing area and provides acoustic output in accordance with the difference signal. In this third preferred embodiment, the difference signal may be inverted by reversing the polarity applied to a particular speaker. Also, in this third preferred embodiment, the difference signals input to the respective left and right speakers may be optionally band limited to substantially remove all frequency components below a predetermined threshold and enable reproduction of the difference signal using exceedingly small, compact speakers.

The present invention may also include a power amplifier for receiving left and right input signals and amplifying the left and right input signals for output to the respective speakers. A powered version having integral amplifiers enables the system designer to generate amplified output signals tailored to the specific speakers selected by the system designer. Such an integrated design approach facilitates optimization of the acoustic output of the system.

The present invention further may accommodate an additional bass speaker to reproduce low frequency components of the stereophonic signal. The bass speaker need only be located generally in the viewing area and provides an acoustic output in accordance with the low frequency components of the (R+L) summation signal.

The present invention further includes an interconnect module to facilitate installation and operation by the user. The interconnect module includes input and output jacks having a predetermined number of terminals. The predetermined number of terminals indicates what signals are input or output by the jacks. For example, a three terminal output jack outputs a left, right and common ground electrical signal, respectively. Such configuration of the input and output jacks insures proper installation of the system because the user may only install the speaker system in one particular configuration. The speaker system design may include the interconnect module as an additional, stand-alone component of the system or may incorporate the interconnect module circuit with one of the existing components, such as the bass speaker or the front speaker.

The present invention further includes a wireless implementation. In the wireless implementation, an electrical audio signal connection provides an audio signal to the interconnect module from the audio signal source. The interconnect module includes active electronics to produce both difference and summation signals. A radio transmitter receives the difference signal and transmits the signal. The left, right, and rear speakers each include a radio receiver tuned to the frequency of the transmitter. The receivers then provide an amplified electrical signal suitable for production of an acoustic output by the associated speaker.

From the subsequent detailed description taken in conjunction with the accompanying drawings and subjoined claims, other objects and advantages of the present invention will become apparent to those skilled in the art.

DETAILED DESCRIPTION OF THE PREFERRED EMBODIMENTS

The following description of the preferred embodiments is merely exemplary in nature and not intended to limit the invention or its application or uses. In the specification, note should be made that elements having similar structures or functions will be referred to using like referenced numerals.

The embodiments described herein provide several improvements over the prior art and will be discussed briefly at the outset. First, this invention involves the spacial distribution of several speakers about the listening room in order to add to the listener's perception of spaciousness. The spacial distribution includes left and right side speakers, a rear speaker, a front (or center) speaker, and a sub-woofer. Second, this invention involves localization of sound radiation patterns to a front or center speaker to create an illusion to the listener that certain sound emanates from that speaker. This invention also involves the reproduction of particular sounds to create ambient surround sound throughout the room. Such sound preferably emanates from speakers other than the front or center speaker. Third, this invention involves frequency band limiting to eliminate particular acoustic frequencies being produced by the left and right satellite speakers. The band limiting frequency is selected in accordance with the desire to eliminate vocal energy output from the satellite speakers. Fourth, this invention involves an atypical overlapping of the frequency ranges of the speaker components. Thus, each of the front, rear, and side speakers each have rather broad, overlapping frequency ranges. Fifth, this invention passively outputs left channel, right channel, left plus right channel, and left minus right channel acoustical signals using several various means of passively generating the signals.

Figure 1:
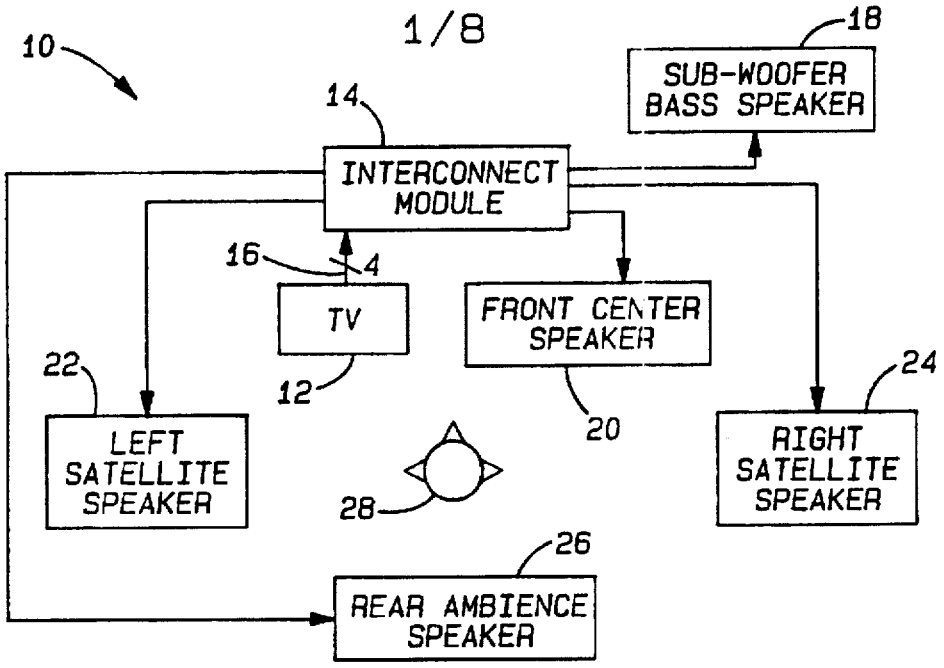
FIG. 1 is a block diagram of the home theater surround sound speaker system arranged in accordance with the principles of the present invention.

FIG. 1 depicts a diagrammatic view of the home theater surround sound speaker system (the surround sound system) 10 arranged in accordance with the principles of the present invention. The surround sound system 10 includes a source of a preferably amplified stereo signal, shown in FIG. 1 as television set 12. The stereo audio source may be any of a number of audio signal sources. It should, thus, be noted that the source of a stereo audio signal is represented herein as television 12, but the audio signal source may also be a stereo receiver, a car stereo, a portable compact disk or tape player, a portable boom-box type stereo, or any other source of a stereo signal.

Television 12 outputs an amplified audio signal to interconnect module 14 via a multiconducter cable 16. Multiconducter cable 16 typically includes two conductor pairs for conducting the left and right channels of the stereo signal output by television 12 to interconnect module 14. Interconnect module 14 receives the audio signals from television 12 and assembles the component left and right channel signals for selective distribution to particular component speakers of the surround sound system 10.

The component speakers typically include a sub-woofer 18 which receives full range left and right signals, but only reproduces the low frequency components of the audio signal. Interconnect module 14 also outputs an audio signal to front center speaker 20. Front center speaker 20 receives both the left and right component signals of the stereophonic signal and reproduces the (L+R) summation signal. Preferably, front center speaker 20 is located in proximity to television 12 and projects the acoustic output of the (L+R) summation signal toward the listener 28.

Interconnect module 14 also outputs the left channel signal to left satellite speaker 22 and right channel signal to right satellite speaker 24. Left satellite speaker 22 and right satellite speaker 24 may be relatively small speakers and need only reproduce mid range and/or high frequency signals. Left and right satellite speakers are preferably oriented so that the primary axis of radiation of the speaker points upward along a vertical axis; however, other orientations of the satellite speakers may also provide satisfactory performance. Interconnect module 14 also outputs an audio signal to rear ambience speaker 26. Rear ambience speaker 26 typically receives an audio signal in the form of a left channel minus right channel (L−R) or a right channel minus left channel (R−L) difference signal. As will become apparent throughout this detailed description, several embodiments of the invention described herein enable interconnect module 14 to generate a variety of signals to be output to left satellite speaker 22, right satellite speaker 24, and/or rear ambience speaker 26. It should be noted at the outset that the term speaker refers to a system for converting electrical input signals to acoustic output signals where the system may include one or a number of crossover networks and/or transducers.

The components described in FIG. 1 typically are arranged to optimize the surround sound effect to enhance the listening experience of the viewer 28. The viewer 28 typically faces television 12 which has front center speaker 20 arranged in proximity to television 12 so that center speaker 20 and television 12 radiate their respective audio and video output in the general direction of viewer 28. The left satellite speaker 22 typically is arranged to the left side of viewer 28 while right satellite speaker 24 is arranged to the right side of viewer 28, both satellite speakers typically being located nominally midway between the viewer 28 and television 12. Rear ambience speaker 26, which contributes to creating a spacious audio effect, is typically located behind viewer 28. Rear ambience speaker 26 is depicted as a single speaker, but multiple rear speakers 26 may be included in the system.

Figure 2:
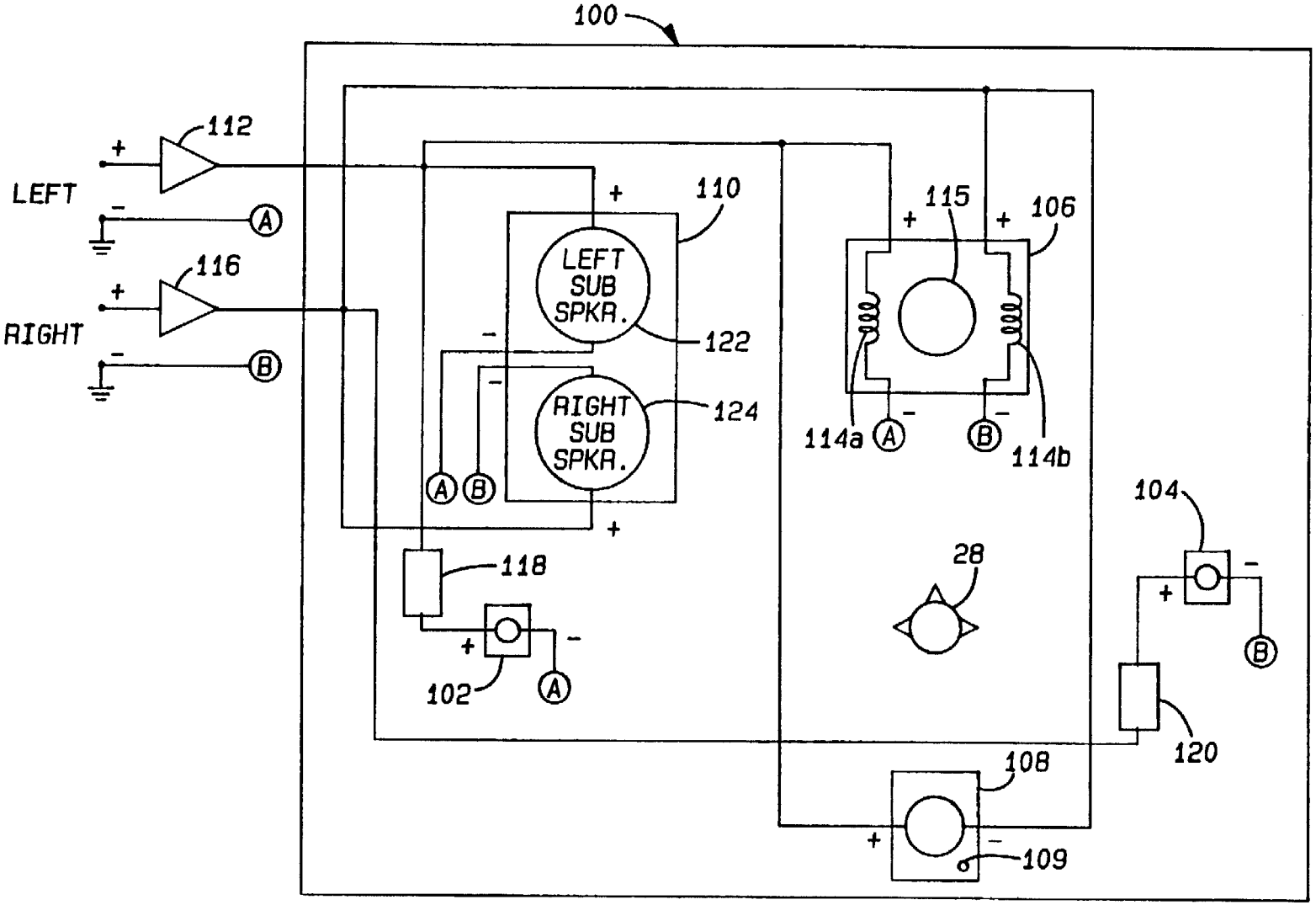
FIG. 2 is an expanded block diagram of a first preferred embodiment of the home theater surround sound speaker system of FIG. 1.

FIG. 2 depicts an expanded block diagram of a preferred embodiment of the present invention. The expanded block diagrams described herein generally include a partial circuit and wiring diagrams and will be interchangeably referred to accordingly throughout this specification as block, circuit, or wiring diagrams. The home theater surround sound speaker system 100 (surround sound system) includes a left side satellite speaker 102 (left side or satellite speaker), right side satellite speaker 104 (right side or satellite speaker), center speaker 106, surround or rear speaker 108, and sub-woofer speaker 110. Left channel amplifier 112 outputs an amplified left channel signal which is input to the positive terminal of voice coil **114*a* of center speaker 106. The negative terminal of voice coil 114*a* of center speaker 106 connects to the negative terminal of left channel amplifier 112. Similarly, right channel amplifier 116 outputs an amplified right channel signal which is input to the positive terminal of voice coil 114*b* of center speaker 106. The negative terminal of voice coil 114*b* of center speaker 106 connects to the negative terminal of right channel amplifier 116. The left and right channel signals are thus connected in phase to the two voice coils 114*a* and 114*b* of center speaker 106 so that the output of center speaker 106** is the sum of the left and right (referred to herein as L+R) channel signals.

The positive terminal of left channel amplifier 112 also outputs an amplified left channel signal to the positive terminal of left side speaker 102, through a filter 118. The negative terminal of left channel amplifier 112 connects to the negative terminal of left side speaker 102. Similarly, the positive terminal of right channel amplifier 116 also outputs an amplified right channel signal to the positive terminal of right side speaker 104, through a filter 120. The negative terminal of right channel amplifier 116 connects to the negative terminal of right side speaker 104. Thus, in the embodiment of FIG. 2, the amplified left and right channel signals are output to the respective left and right side speakers.

Left side speaker 102 and right side speaker 104 are preferably band limited to reproduce only higher frequencies, as shown using left high pass filter 118 and right high pass filter 120. The use of high pass filters 118 and 120 with the respective left and right side speakers 102 and 104 limits the acoustic output of left and right side speakers 102 and 104 to high frequencies. As will be described in greater detail with respect to FIGS. **4*a* and 4*b*, such band limiting of satellite speakers 102 and 104 excludes the primary frequency range of vocal energy. The listener, thus, perceives dialog sound to come only from the front speaker 20 located in proximity to the video image. Examples of such high pass filters will be described in greater detail with respect to FIG. 4*a* and 4*b***.

The surround sound system 100 also includes a rear speaker 108. The inputs to rear speaker 108 provide a resultant left minus right (L−R) difference signal. To effect this difference signal, the positive terminal of left channel amplifier 112 outputs the amplified left channel signal to the positive terminal of rear speaker 108, and the positive terminal of right channel amplifier 116 outputs the amplified right channel signal to the negative terminal of rear speaker 108. The above-described connections to rear speaker 108 provides the desired (L–R) difference signal. Rear speaker 108 also includes a potentiometer 109. The potentiometer 109 enables adjustment of the rear speaker acoustic output relative to the output of the other speakers in the system. Such output is typically adjusted in accordance with the proximity of the rear speaker to the listener. It will be recognized by one skilled in the art that a reversed polarity connection to rear speaker 108 provides a (R–L) difference signal, rather than a (L–R) difference signal. The polarity of the difference signal radiated by the rear speaker does not significantly affect the performance of the surround sound system 100, and either alternative may be selected.

Surround sound system 100 further includes a sub-woofer 110. The positive terminal of left channel amplifier 112 outputs the amplified left channel signal to the positive terminal of left sub-woofer speaker 122. The negative terminal of left channel amplifier 112 connects to the negative terminal of left sub-woofer speaker 122. Similarly, the positive terminal of right channel amplifier 116 outputs the amplified right channel signal to the positive terminal of right sub-woofer speaker 124. The negative terminal of right channel amplifier 116 connects to the negative terminal of right sub-woofer speaker 124. Thus, in the embodiment of FIG. 2, the left channel signal drives the left sub-woofer speaker 122 and the right channel signal drives the right sub-woofer speaker 124, respectively. The resultant output of the left and right sub-woofer speakers thus sum acoustically. It will be understood by one skilled in the art that the center channel speaker 108 could alternatively operate over a full frequency range, including the bass range, thereby eliminating the sub-woofer.

In an alternative embodiment to the above-described preferred embodiment, the left and right amplifiers 112 and 116 could be integrated into the system. For example, left and right channel amplifies 112 and 116, while generally assumed throughout this specification to be output amplifiers commonly found and included in the above-mentioned audio signal sources, may be specifically selected amplifiers forming a portion of surround sound system 100. Amplifiers 112 and 116 in this alternative embodiment would receive low level input signals from the audio signal source. Amplifiers 112 and 116 would further amplify the input signal for output to the surround sound system speakers. To effect such a configuration, output amplifiers 112 and 116 may be incorporated into interconnect module 14 (as shown in FIG. 1). Interconnect module 14 would preferably be independently powered to drive amplifiers 112 and 116. A particular advantage of this alternative configuration is that output amplifiers 112 and 116 could be designed to specifically integrate with the speaker electrodynamic characteristics.

One preferred embodiment of the surround sound system 100 includes a center speaker 106 comprising a sealed enclosure of approximately 50 cubic inches housing a commercially available 3 inch diameter dual 8 ohm voice coil electrodynamic transducer. A pair of 100 micro farad capacitors connected in series with the positive output of the respective left and right channel signals performs a crossover function. The center speaker 106 has an operating bandwidth above approximately 150 Hz. The rear speaker 108 uses a similar configuration, but uses a single voice coil, rather than a dual voice coil transducer. The rear speaker 108 includes a sealed enclosure of approximately 50 cubic inches and houses a commercially available 3 inch diameter single 8 ohm voice coil electrodynamic transducer. Potentiometer 109 is an 8 ohm, 15-watt L-pad or a 25 ohm, 3 watt wirewound potentiometer. Potentiometer 109 allows a variation in the output level of rear speaker 108. A 68 micro farad capacitor connected in series with the input to the positive terminal of the voice coil performs a crossover function. The nominal frequency band of the rear speaker 108 is 150 Hz to 8 kHz. The rear speaker 108 reproduces a (L–R) difference signal, as described with respect to FIG. 2. The side speakers 102 and 104 each comprise a sealed enclosure of approximately 2 cubic inches and houses a commercially available nominal 4 ohm impedance 1.5 inch diameter plastic cone tweeter. A pair of 4.7 micro farad capacitors connected in series with the positive inputs to side speakers 102 and 104 provide high pass filtering for left highpass filter 118 and right high pass filter 120. The high pass filters 118 and 120 provide a nominal frequency band of approximately 4 Khz to 15 KHz output from side speakers 102 and 104. The sub-woofer 110 is a conventional dual volume enclosure design comprised of a nominal 580 cubic inch sealed volume and a nominal 450 cubic inch ported volume operating in conjunction with a pair of 5.25 inch diameter 4 ohm voice coil electrodynamic transducers. A pair of 0.8 milli-Henry inductors in series with the positive input to each of the transducers perform a crossover function. The sub-woofer bass unit 110 nominally operates in the frequency band of 50 Hz to 200 Hz. It should be noted that in each of the above-described speakers, the crossover network is integrated into the enclosure for the associated speaker. Further, it will be noted that the band limiting filters 118 and 120 are integrally included in speakers 102 and 104, respectively. In this manner, the band limiting device and the associated satellite speaker form an integral unit. This provides the added benefit that the interconnect module 14 of FIG. 1 may simply be comprised of appropriately wired input and output jacks.

Figure 3:
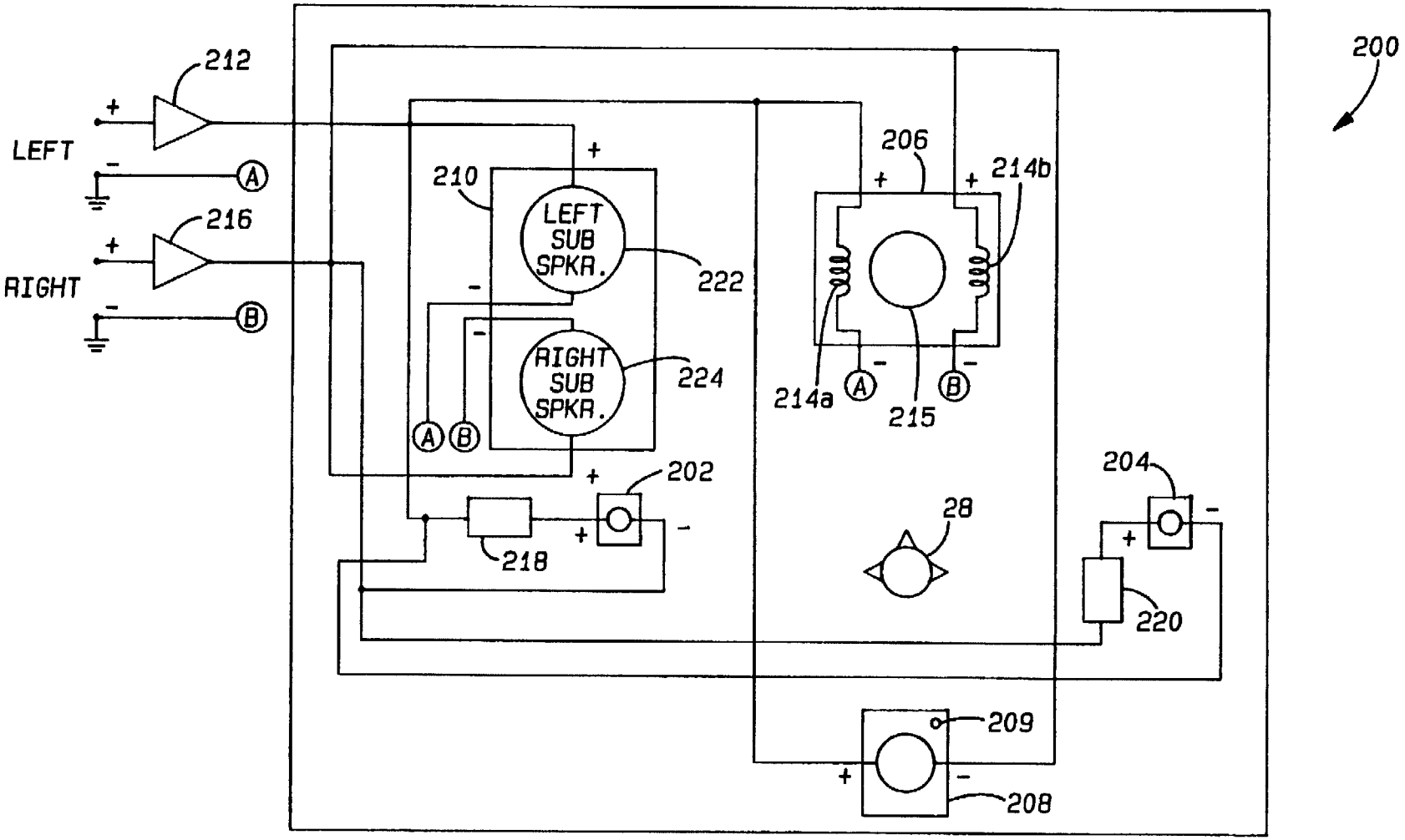
FIG. 3 is an expanded block diagram of a second preferred embodiment of the home theater surround sound speaker system of FIG. 1 in which difference signals are output to the left and right satellite speakers.

FIG. 3 depicts a second preferred embodiment of the present invention. The home theater surround sound speaker system (surround sound system) 200 of FIG. 3 employs similar components to those employed in surround sound system 100 of FIG. 2, and similar components will be referred to using reference numerals starting with 200 rather than 100. The surround sound system 200 of FIG. 3 is as described in FIG. 2 except that left side speaker 202 and right side speaker 204 are configured to reproduce difference signals (L–R) and (R–L), respectively. The positive terminal of left channel amplifier 212 outputs an amplified left channel signal to the positive terminal of left side speaker 202, via a filter 218. The positive terminal of right channel amplifier 216 outputs an amplified right channel signal connected to the negative terminal of left side speaker 202. Similarly, the positive terminal of right channel amplifier 216 outputs an amplified right channel signal to the positive terminal of right side speaker 204, via a filter 220. The positive terminal of left channel amplifier 212 outputs an amplified left channel signal connected to the negative terminal of right side speaker 204. These connections effect a (L–R) difference signal input to left side speaker 202 and a (R–L) difference signal input to right side speaker 204.

As described with respect to FIG. 1, left high pass filter 218 and right high pass filter 220 filter out low frequency components of the input signals applied to left side speaker 202 and right side speaker 204, respectively. In applications where the satellite speakers receive difference signals as inputs, high pass filtering, as described in FIG. 2, of the difference signals becomes optional. However, there are two additional benefits to high pass filtering the (L–R) difference signals. First, the physical size of the side speakers can remain small. Second, mismatches in the left and right channel signal gains can cause dialog to leak into the difference signal. Bandlimiting the difference signal helps ensure that localization of dialog remains at the location of the center speaker, even when the signals in the left and right channels are not exactly equal and dialog leaks in the difference signal, by filtering out this leakage signal in the primary voice frequency range.

In an alternative configuration of the second, preferred embodiment, reversing the polarity of the difference signals results in a (L–R) difference signal applied to the right side speaker 204 and a (R–L) difference signal applied to the left side speaker 202. In yet another alternative embodiment, a (L–R) difference signal could be applied to both side speakers 202 and 204, or a (R–L) difference signal could be applied to both side speakers 202 and 204. The particular polarity of the difference signal applied to the side speakers does not materially affect the performance of the system when the difference signals are band limited, because the side speakers operate nominally above 1 Khz where the acoustic difference is inaudible. Further, because the sound signal wavelengths in this frequency range are relatively short, small changes in the relative placement of side speakers 202 and 204 will have more of an effect on the way in which signals combine at the listening position than will the relative polarity of the signals applied to the side speakers.

A particular advantage of driving the left side speaker 202 and right side speaker 204 with the difference signal (whether (L–R) or (R–L)) is that the difference signal removes sound components recorded equally in the left and right channels, effectively decoupling reproduction of dialog and ambient surround sound. Considering a system where the left and right channel signals are output to the respective left and right side satellite speakers, residual vocal energy harmonics may still reside in the left and right signals at higher frequencies, such as harmonic overtones, heard as sibilant sounds. When such sibilant sounds are reproduced by the satellite speakers, the satellite speakers provide a directional cue that can result in an unnatural breath to the dialog and smear the sonic image. The difference signal, however, eliminates these problems by eliminating all vestiges of the dialog energy from the ambience surround sound. A further benefit may be obtained by band limiting the difference signal which substantially contains only ambient surround sound information. Band limiting the difference signal enables use of a much smaller satellite speaker because the satellite speaker need only reproduce high frequency acoustic output. Thus, the combination of band limiting and the use of difference signals succeeds in decoupling the reproduction of dialog and ambient sounds, which assures localization of dialog to the video image while maintaining a consistent ambient sound field. This decoupling introduces a fundamental difference between the passive system of the invention herein and active surround sound decoding systems. The passive system described does not introduce any sonic artifact when dialog comes and goes within an ambient sound field recorded in the soundtrack. Thus, a consistent ambient sound field results while dialog remains localized to the video screen. The connections for the center speaker, sub woofer, and rear speaker shown in FIG. 3 are the same as described with respect to FIG. 2. Left channel amplifier 212 outputs an amplified left channel signal which is input to the positive terminal of voice coil 214*a* of center speaker 206. The negative terminal of voice coil 214*a* of center speaker 206 connects to the negative terminal of left channel amplifier 212. Similarly, right channel amplifier 216 outputs an amplified right channel signal which is input to the positive terminal of voice coil 214*b* of center speaker 206. The negative terminal of voice coil 214*b* of center speaker 206 connects to the negative terminal of right channel amplifier 216. The left and right channel signals are thus connected in phase to the two voice coils 214*a* and 214*b* of center speaker 206 so that the output of center speaker 206 is the left and right summation signals.

Referring again to FIGS. 2 (and 3), the left side speaker 102 (202) and right side speaker 104 (204) receive the amplified signals output by the left and right channel amplifiers 112 (212) and 116 (216), respectively. However, the operating bandwidth of the side speakers 102 (202) and 104 (204) is restricted. The bandwidth of the side speakers 102 (202) and 104 (204) in the present invention is limited to a frequency range substantially above the primary frequency range of voice signals or dialog output by center speaker 106 (206). More particularly, the primary energy in speech signals is contained in the frequency range of approximately 150 Hz to 1 Khz. Side speakers 102 (202) and 104 (204) are bandwidth limited by high pass filters 118 (218) and 120 (220), respectively, to operate in the frequency range at least above approximately 1 Khz.

Figure 4A:
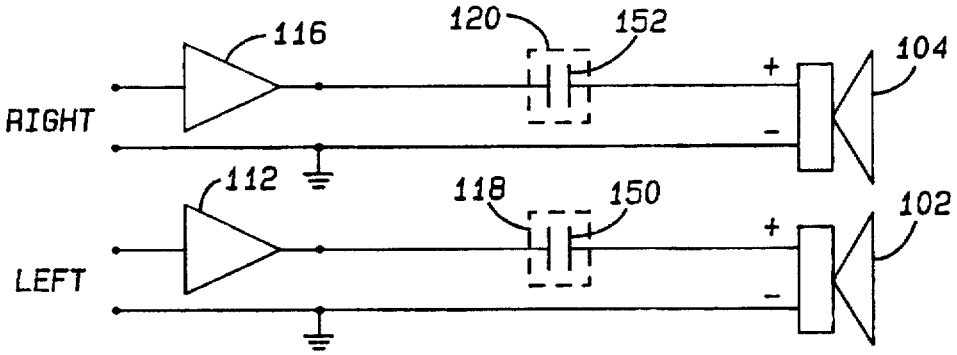
FIGS. 4*a* and 4*b* are circuit diagrams for first and second order, respectively, high pass filters for bandwidth limiting the input signal to the left and right satellite speakers.
Figure 4B:
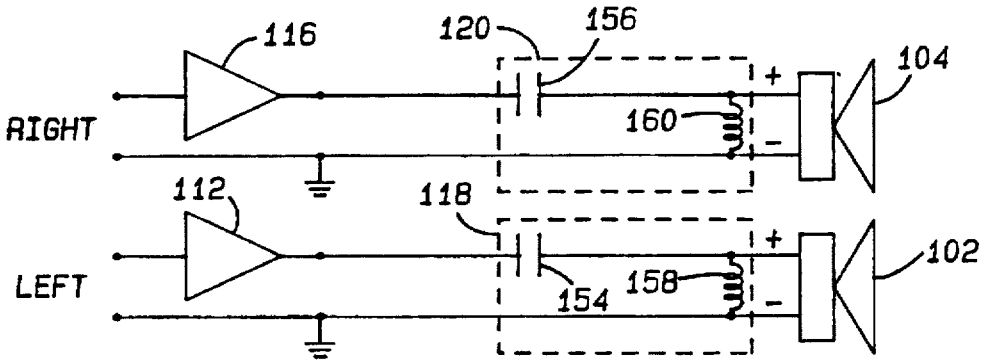

FIG. 4*a* shows a pair of first order high pass networks to implement the high pass filtering on signals input to left side speaker 102 (202) and right side speaker 104 (204) of FIGS. 2 and 3. The left high pass filter 118 (218) and right high pass filter 120 (220) include capacitors 150 and 152, respectively, connected in series with side speakers 102 (202) and 104 (204). Such a filtering configuration is referred to as a first order highpass filter. FIG. 4*b* demonstrates left high pass filter 118 (218) and right high pass filter 120 (220) implemented as second order high pass networks. Capacitors 154 and 156 are connected in series with the positive terminals of side speakers 102 (202) and 104 (204), respectively, and inductor 158 and 160 are connected in shunt across the positive and negative terminals of side speakers 102 (202) and 104 (204). The operation of the high pass networks depicted in FIGS. 4*a* and 4*b* is well understood by those skilled in the art and will not be explained herein.

It will further be recognized by one skilled in the art that high pass filters 118 (218) and 120 (220) may be implemented in any of a number of configurations known in the art. The use of a passive high pass filter is readily recognized as one approach to band limiting signals. It will be further recognized by one skilled in the art that the cut off frequency may be varied in accordance with the particular implementation desired.

Bandwidth limiting the frequency range of the signals input to the side speakers 102 (202) and 104 (204) substantially removes dialog localization cues from the side speakers 102 (202) and 104 (204) so that primary dialog localization cues are only reproduced by the center speaker 106 (206), which is in proximity to the video image. Bandwidth limiting side speakers 102 (202) and 104 (204) forces dialog localization to the location of the center speaker 106, as the center channel becomes the only speaker in the system that reproduces the fundamental dialog localization cues. The left side speaker 102 (202) and right side speaker 104 (204) reproduce left and right channel higher frequency information, respectively, that is generally greater than the frequency range of primary speech. The side speakers 102 (202) and 104 (204), thus, assist in providing an increased sense of spaciousness without altering localization of speech sounds. It has been shown through numerous studies of concert hall acoustics that a sense of spaciousness correlates with the presence of lateral reflections. That is, spaciousness correlates with energy arriving at the listening position from the sides of the listening space. Locating the side speakers 102 (202) and 104 (204) at the sides of the listening room and orienting the major axis of radiation vertically upward enables the side speakers 102 (202) and 104 (204) to generate significant lateral energy at the listening position, thus enhancing spaciousness. Additionally, because the side speakers 102 (202) and 104 (204) of the present invention are band limited to significantly reduce dialog localization cues, they can be displaced further to the sides of the listener than traditional speakers. Moreover, because the side speakers 102 (202) and 104 (204) are band limited, the increased displacement does not cause distracting sound images to the sides of the listener, as would occur if full frequency range side speakers were placed in these locations. This allows the side speakers to be placed for maximum spaciousness without generating distracting sound images.

An additional benefit to band limiting the side speakers is that their physical size may be relatively small. Band limiting the side speakers to above approximately 1 Khz presents a much different configuration than typical satellite/sub-woofer systems. In most satellite/sub-woofer systems, the satellite speakers operate over a much larger frequency range, typically down to as low as 150 Hz. Such speakers are therefore required to be much larger than the side speakers of the present invention in order to generate sufficient energy at these lower frequencies. In the present invention, the side speakers reproduce a much more restricted frequency range.

Figure 5A:
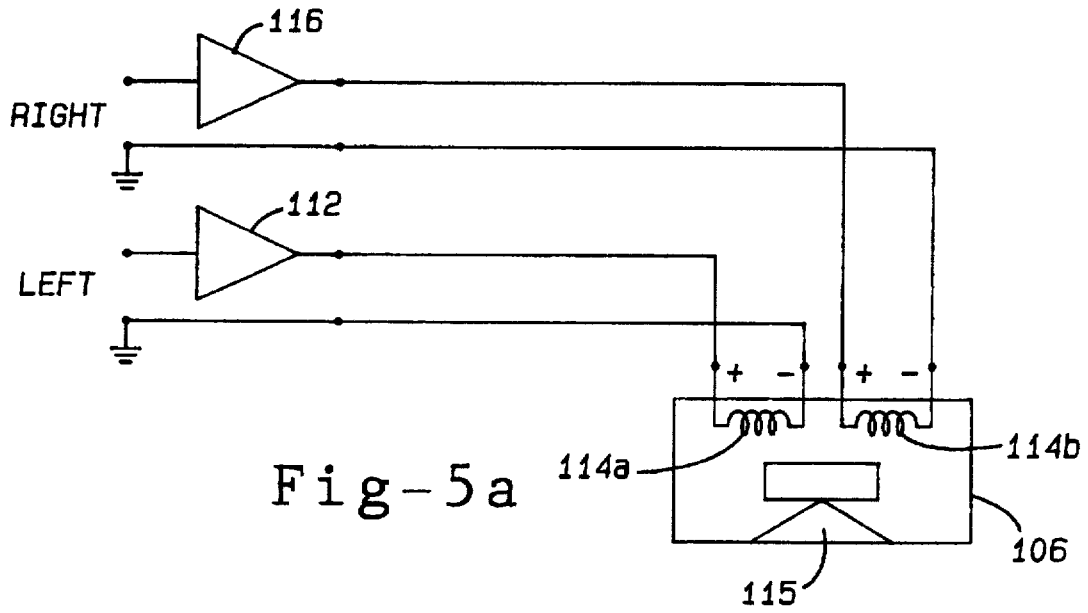
FIGS. 5*a* and 5*b* are circuit diagrams for applying a left plus right (L+R) summation signal to the center speaker using a single transducer and a dual transducer configuration, respectively.

FIG. 5*a* depicts a center speaker 106 (206) comprised of a dual voice coil 114*a* and 114*b* (214*a* and 214*b*) and single transducer 115 (215) as shown in FIGS. 2 and 3. The amplified left channel signal is applied to voice coil 114*a* (214*a*) and the amplified right channel signal is applied to voice coil 114*a* (214*b*). In this configuration, the left and right channel signals are summed electromagnetically within the transducer 115 (215).

Another particular advantage of this invention can be demonstrated with particular respect to FIG. 5*a*. In FIG. 5*a*, the left and right channel signals output by the respective amplifiers 112 and 116 each individually applied to voice coil 114*a* and 114*b* of transducer 115 to electromagnetically create the (L+R) summation signal. The center speaker of FIG. 5*a* thus generates the summation signal passively, without the need for a resistor divider network which would consume power and add cost and complexity to the system. Such power savings is particularly relevant when the invention described herein obtains the left and right channel signals from a relatively low power amplifier source, such as a typical stereo television set or boom-box type portable stereos. Left plus right summation within the speaker itself avoids the requirement for extra parts and their associated costs.

Figure 5B:
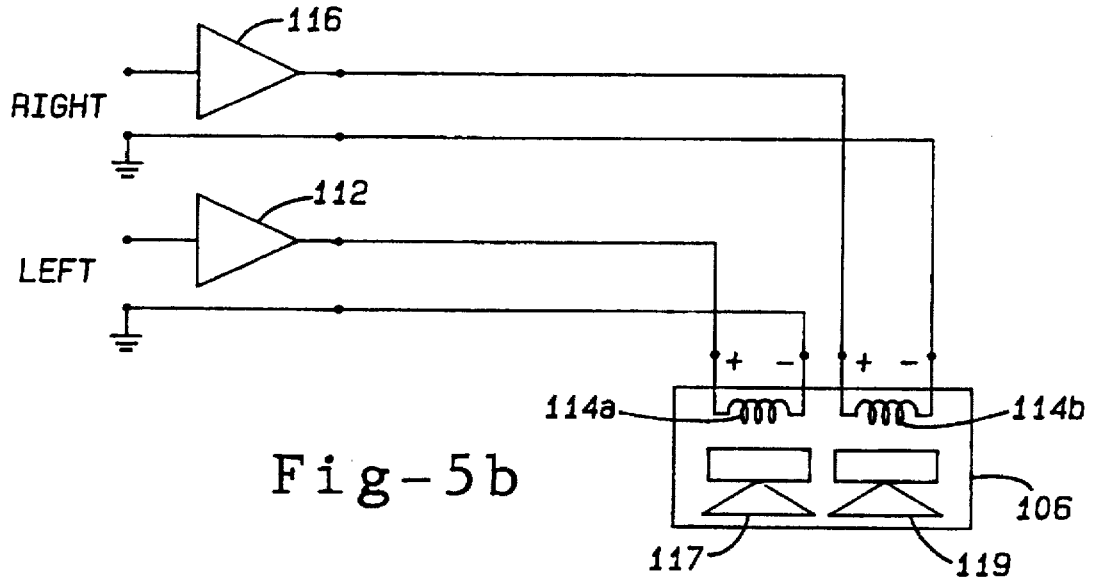

In an alternative center channel configuration shown in FIG. 5*b*, the left and right channel signals drive individual left and right transducers 117 and 119. The left channel amplified signal drives voice coil 114*a* (214*a*) which in turn drives left transducer 117. The right channel amplified signal drives voice coil 114*b* (214*b*) which in turn drives transducer 119.

It should be noted that in the configuration of FIG. 5*b*, the transducers 117 and 119 should be located in relatively close proximity so that the outputs from both transducers 117 and 119 sum acoustically over a maximum possible frequency range. Effective acoustical summation requires that the two transducers be located within approximately ¼ of a wavelength of each other. Such proximity is not practically achieved over the entire audible frequency range. At higher frequencies, some comb filtering will occur in the combined acoustical output from the two transducers. In the case of a monophonic signal, because both transducers radiate the same signal and are displaced in space, the resultant path length difference between the listening location and each transducer becomes an appreciable fraction of a wavelength, or multiple wavelengths, at higher frequencies. Minimizing the spacing between the two elements, thus, minimizes the amount of comb filtering that occurs.

Figure 6A:
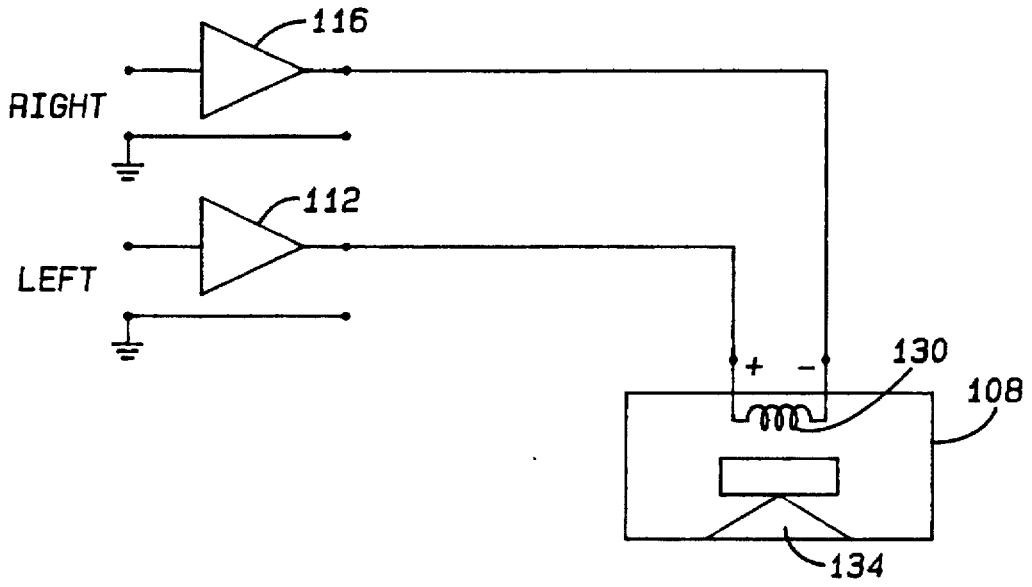
FIGS. 6*a* and 6*b* are circuit diagrams for applying a left minus right (L–R) difference signal to the rear speaker of the home theater surround sound speaker system using single and dual voice coil configurations, respectively.
Figure 6B:
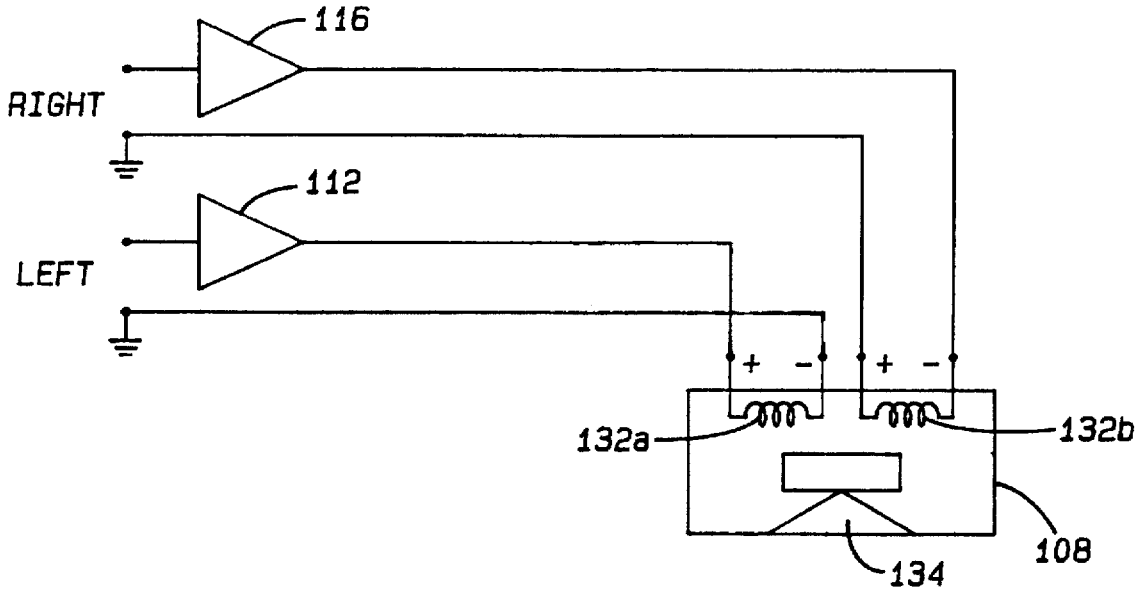

FIG. 6 depicts two alternative embodiments for obtaining (L–R) difference signal from rear speaker 108 (208) of FIGS. 2 and 3. The difference signal typically contains ambiance and surround sound information. FIG. 6*a* depicts a circuit diagram for a preferred embodiment for obtaining the (L–R) signal in a passive system. The left channel amplifier 112 (212) outputs an amplified left channel signal which is input to the positive terminal of voice coil 130 of the rear speaker 108 (208), and the right channel amplifier 116 (216) outputs an amplified right channel signal to the negative terminal of voice coil 130. The rear speaker 108 (208), thus outputs audio responsive to the difference between the left and right channel signals (L–R) through transducer 134. FIG. 6*b* depicts a circuit diagram for an alternative configuration for obtaining a (L–R) difference signal. The rear speaker 108 includes dual voice coils 132*a* and 132*b*. Voice coil 132*a* receives at its positive terminal the amplified left channel signal from left channel amplifier 112 (212). The negative terminal of voice coil 132*a* is connected to the negative terminal of left channel amplifier 112 (212). Voice coil 132*b* receives the amplified right channel signal from the right channel amplifier 116 (216) at its negative terminal, and the positive terminal of voice coil 132*b* connects to the negative terminal of right channel amplifier 116 (216). Thus, this configuration reverses the polarity of the connection so that transducer 134 outputs a resultant (L–R) signal.

Figure 7:
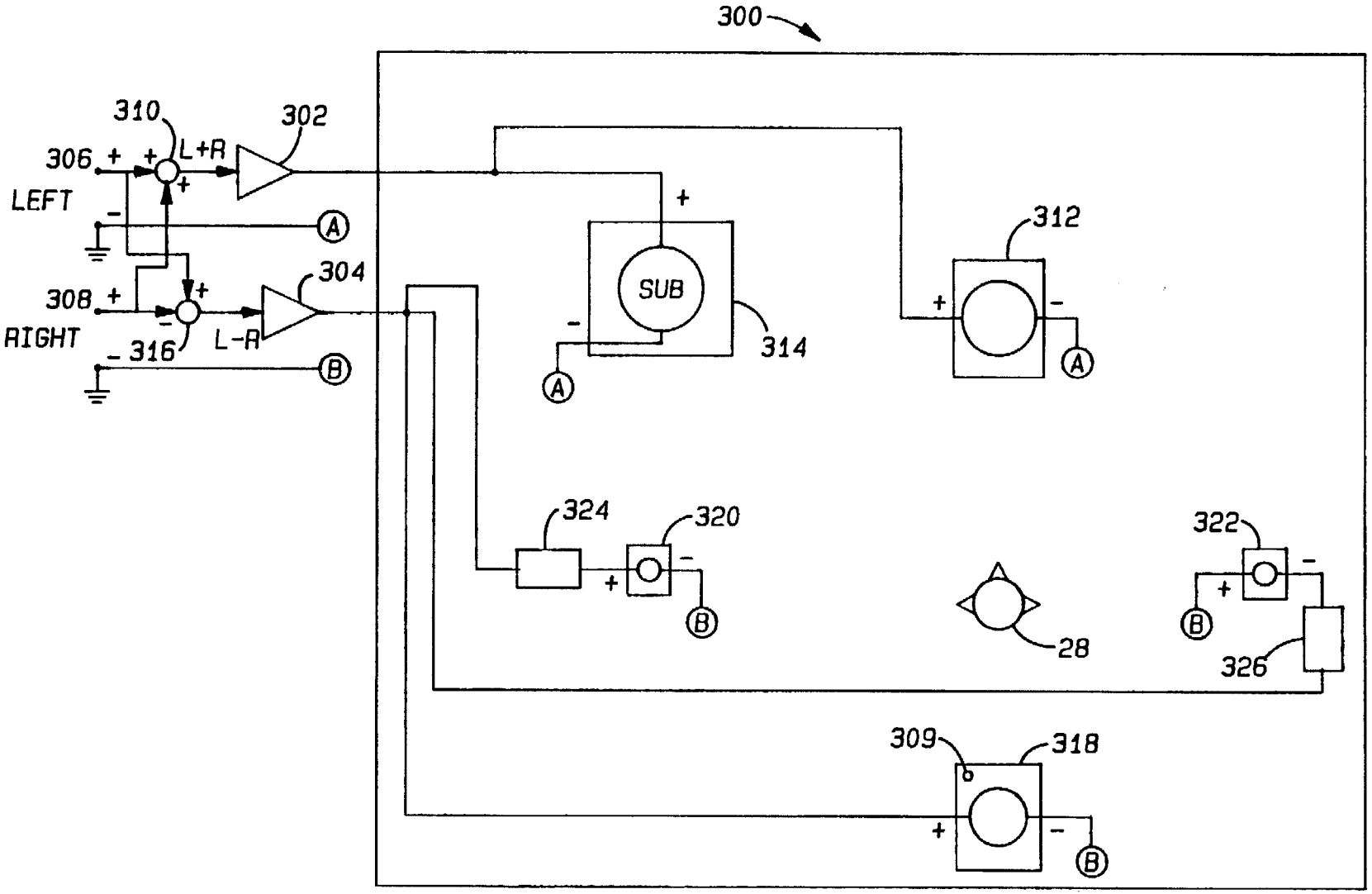
FIG. 7 is an expanded block diagram of a third preferred embodiment of the home theater surround sound speaker system in which left and right channel difference and summation signals are actively generated prior to output to the speakers.

FIG. 7 depicts a third preferred embodiment of the present invention in which a home theater surround sound speaker system 300 employs low level signal processing prior to amplification by the amplifier 302 and amplifier 304. Left channel positive signal 306 and right channel positive signal 308 feed into summing amplifier 310, any number of said summing amplifiers for electronically adding signals of which are known in the art. The output of summing amplifier 310 provides a (L–R) summation signal which is in turn input to power amplifier 302. The positive output of amplifier 302 supplies an amplified (L+R) signal to the positive terminal of center speaker 312. The negative terminal of center speaker 312 connects to the negative terminal of amplifier 302.

The positive terminal of power amplifier 302 also outputs a driving signal to the positive terminal of sub-woofer 314. Sub-woofer 314 comprises a single transducer and voice coil. Similarly to center speaker 312, because the (L+R) signal drives sub-woofer 314, sub-woofer 314 requires only a single voice coil and transducer to output the low frequency portions of the left and right signals. It will be recognized by one skilled in the art that alternative configurations of particular sub-woofers may be used with the present invention with minimal effect on the functioning of the system.

Surround sound system 300 also actively provides a difference signal. Prior to amplification by amplifier 304, left channel positive signal 306 and right channel positive signal 308 feed into difference amplifier 316. The output of difference amplifier 316 outputs a left minus right (L–R)

difference signal. This (L–R) difference signal is input to power amplifier 304. The positive output of power amplifier 304 in turn drives the positive terminal of rear speaker 318. The negative terminal of rear speaker 318 is connected to the negative terminal of power amplifier 304. Thus, the (L–R) signal output by amplifier 304 drives rear speaker 318.

The positive terminal of amplifier 304 also outputs a driving signal to the positive terminal of left side speaker 320 through high pass filter 324. The negative terminal of left side speaker 320 connects to the negative terminal of power amplifier 304. Similarly, the positive terminal of power amplifier 304 outputs a driving signal to the negative terminal of right side speaker 322 through highpass filter 326. The positive terminal of right side speaker 322 connects to the negative terminal of power amplifier 304. The connection to left side speaker 320 provides a resultant (L–R) driving signal to the speaker. The connection to right side speaker 322 provides a resultant (R–L) signal to the speaker. The polarities of the signals applied to each of left side speaker 320, right side speaker 322, and to rear speaker 318 may be reversed and the system will provide the same effect. All possible permutations of relative polarity connections of the difference signal to the two side speakers and the rear speaker are also acceptable and provide satisfactory results. High pass filters 324 and 326 operate as described above with respect to FIGS. 2 and 3.

This configuration lends itself particularly to a powered variation in which the interconnect module could include an internal amplifier to amplify the electrical input signals and output amplified electrical signals to drive the respective speakers. A particularly advantageous feature of an internally powered interconnect module would be that the option exists to unsymmetrically amplify the output signals so that speakers requiring greater energy to operate satisfactorily receive higher powered input signals. For example, the summation signal input to the center and bass speakers could be output at a much higher power rating than the difference signal output to the satellite and rear ambient speakers. This approach provides the high power for driving the bass and front speakers while leaving less, but sufficient power to drive the side and rear speakers. For example, rather than a 10-watt plus 10-watt stereo amplifier configuration, an 18-watt plus 2-watt amplifier configuration could be used to more efficiently employ the available power.

Figure 8:
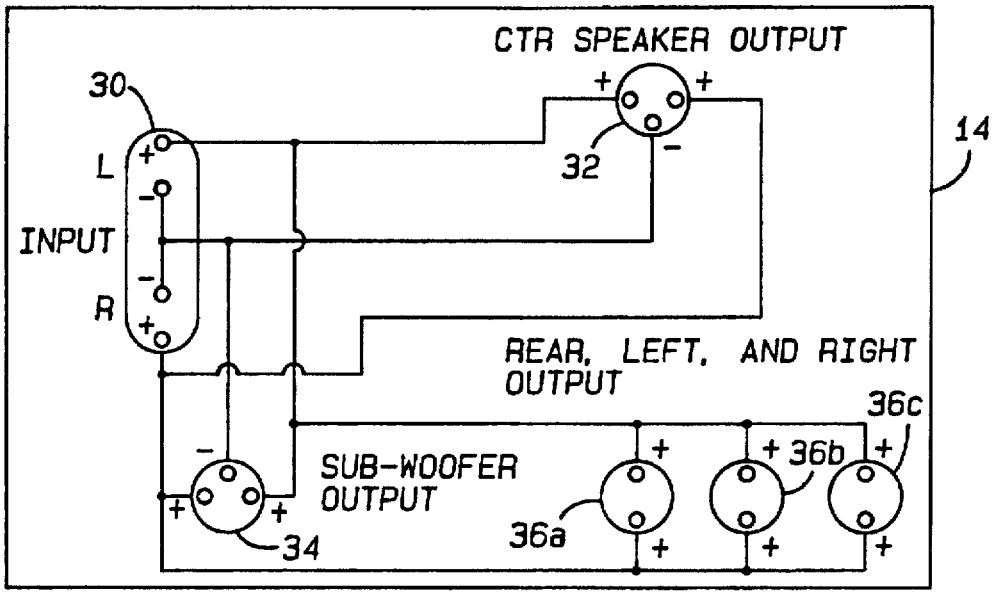
FIG. 8 is a wiring diagram for an interconnect module for the home theater surround sound speaker system used to facilitate mistake-free installation and operation of the system.

A particularly desirable feature of most surround sound systems is ease of installation and operation to avoid discouraging use by non-technical consumers. This invention solves most installation difficulties by providing a home theater interconnect module 14 with connection jacks which confine the system to one and only one possible set of speaker connections for the particular embodiments where the (L–R) difference signals are output to the side speakers. FIG. 8 is a wiring diagram showing the interconnection jacks within interconnect module 14 of FIG. 1, and will be described with reference to the components discussed in FIG. 1.

Interconnect module 14 includes a four terminal input jack 30 for receiving the component left and right channel signals input to the interconnect module 14 from television 12. The left and right channel signals are received via a four conductor wire terminating at a four terminal connector which mates appropriately with four terminal input jack 30. The negative inputs for the left and right channels are tied together within interconnect module 14 to provide a common ground signal for each of the input and output connections. The output to center speaker 20 (of FIG. 1) is provided via a three terminal output jack 32. The three terminals of output jack 32 provide outputs comprising the left channel signal, the right channel signal, and a common ground signal. A second three terminal sub-woofer output jack 34 provides similar output signals to sub-woofer 18. Sub-woofer output jack 34 similarly provides the left channel signal, the right channel signal, and a common ground signal on the respective terminals.

A trio of two terminal output jacks **36*a*, 36*b*, and 36*c* provide the left channel signal on one terminal and the right channel signal on the other terminal. Each of these jacks interconnect to cables which in turn connect to one of the rear speaker 26, the left satellite speaker 22, and the right satellite speaker 24. The resultant signal provided to those speakers is the left minus right difference signal. The configuration of interconnect module 14 is thus particularly adapted to the preferred embodiment shown in FIG. 3 where the left satellite speaker 22, right satellite speaker 24, and rear speaker 26 have the difference signals as inputs. It will be recognized by one skilled in the art that output jacks 36*a*, 36*b*, and 36*c*** are interchangeable because each outputs substantially identical signals.

One of the particularly advantageous features of interconnect module 14 is that center speaker output jack 32 and sub-woofer output jack 34 may be identical jacks which output identical signals on each terminal. Thus, during installation, the operator may install the system in only one configuration. The operator cannot connect the cable connector (not shown) for center speaker 20 or rear speaker 26 to one of output jacks **36*a*, 36*b*, or 36*c*. Similarly, output jacks 36*a*, 36*b*, and 36*c* result in identical signals on each terminal. That is, all similarly shaped output (and input) jacks provide (receive) the same signals. Similarly, the operator cannot connect the cable connector for the satellite or rear speakers to the center speaker output jack 32 or sub-woofer output jack 34. The operator can only connect the cable connector to one of the jacks which outputs the appropriate signal(s) for a particular speaker. In addition, the particular operation of this invention facilitates configuring the interconnect module 14 to enable ease of installation. Another particularly advantageous feature of the present invention is that the interconnect module 14** is particularly adaptable to standard 2,3, and 4 conductor cables which facilitates low cost manufacturing due to the use of readily available parts.

Figure 9:
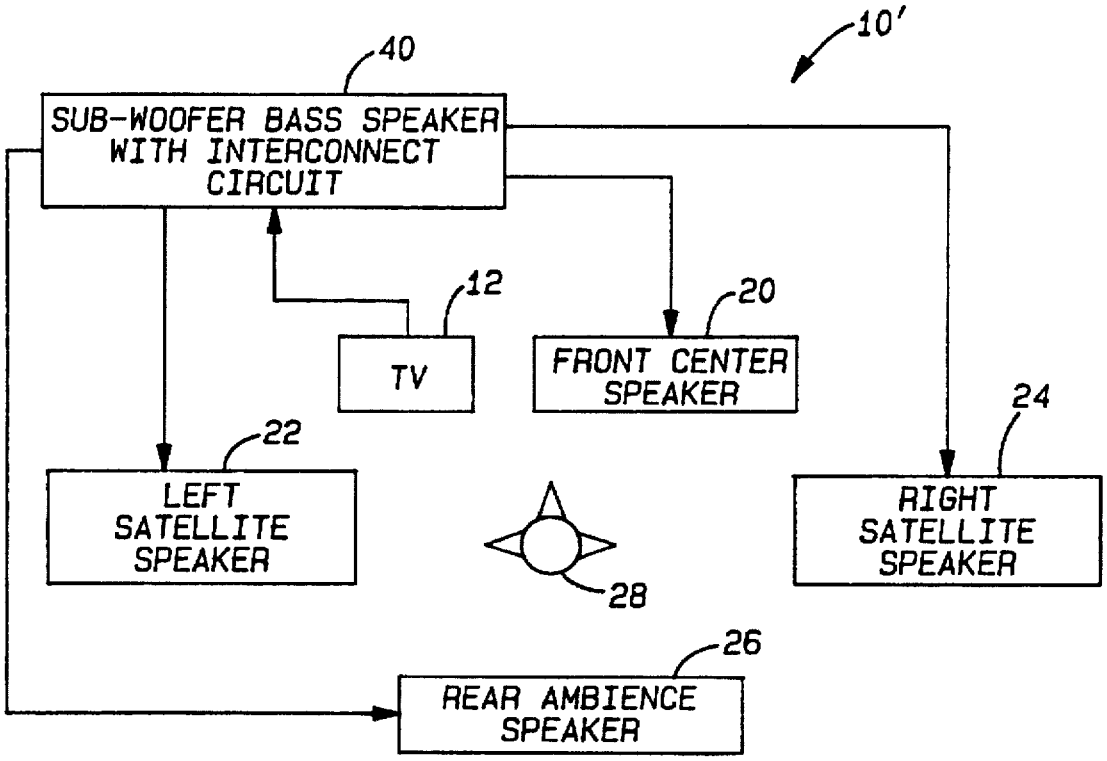
FIG. 9 is a block diagram of an alternative configuration for the home theater surround sound speaker system depicted in FIG. 1.

An enhancement to any home theater surround sound system results from reducing the number of components. One approach to component reduction is to consolidate components where possible. For example, referring to FIG. 1, interconnect module 14 and sub-woofer 18, may logically be consolidated into a single component. FIG. 9 depicts such an alternative configuration for the home theater surround sound speaker system 10 of FIG. 1. The home theater surround sound speaker system (surround sound system) 10' of FIG. 9 is similarly arranged as in FIG. 1, and reference numerals in FIG. 9 refer to similar components from FIG. 1. As can be seen in FIG. 9, television 12 outputs an audio signal to integral sub-woofer bass speaker and interconnect module 40 (integral bass unit). The integral bass unit 40 performs the combined function of interconnect module 14 and sub-woofer 18 of FIG. 1. Interconnect module 14 has been incorporated into the sub-woofer bass speaker housing in order to reduce the number of parts and cabling requirements and to further facilitate installation. Integral bass unit 40 includes an interconnect portion for distributing the appropriate signals to each of front center speaker 20, left satellite speaker 22, right satellite speaker 24, and rear ambiance speaker 26. Integral bass unit 40 also includes a sub-woofer directly wired to the interconnect circuitry housed in integral bass unit 40. In this manner, the system requires one less cable (between interconnect module and the sub-woofer bass speaker) and also requires one less individual or stand-alone component (the interconnect module).

Figure 10:
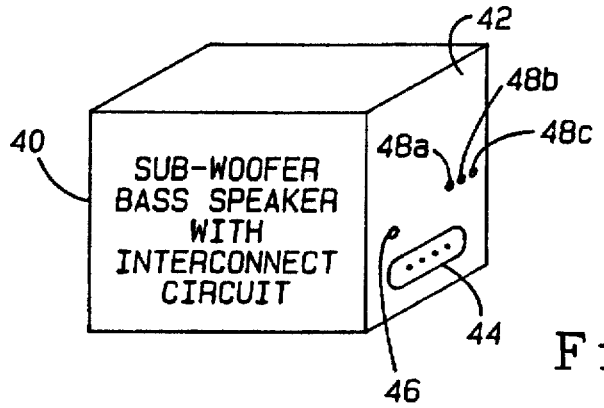
FIG. 10 is a perspective view of an integral sub-woofer bass unit and interconnect module.

FIG. 10 depicts an exemplary perspective view of integral bass unit 40. Integral bass unit 40 includes an interconnect module 42 having arranged thereon input and output jacks for receiving the incoming audio signal and distributing the left, right, and difference signals to the appropriate speakers. Interconnect module 42 includes a four terminal input jack 44 for receiving via a four conductor wire the left and right channel signals. Interconnect module 42 also includes a three terminal center speaker output jack 46 and a trio of two terminal output jacks 48*a*, 48*b*, and 48*c*. Interconnect module 42 is arranged similarly to interconnect module 14 of FIG. 8 and the principles discussed with respect to FIG. 8 apply equally to FIG. 10.

Figure 11:
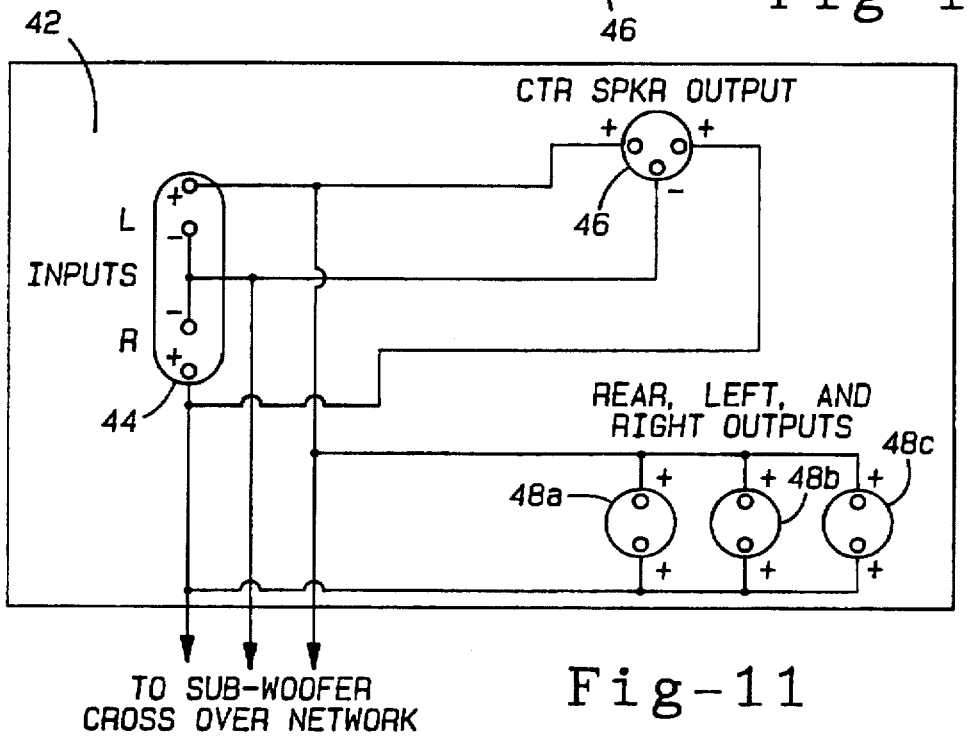
FIG. 11 is a wiring diagram for the home theater surround sound speaker system sub-woofer bass unit and integral interconnect module of FIG. 10 used to facilitate mistake-free installation and operation of the system.

One particular difference between interconnect module 42 of FIG. 11 and interconnect module 14 of FIG. 8 is that because interconnect module 42 is integrally housed with the sub-woofer bass speaker, interconnect module 42 does not require a sub-woofer output jack (as does interconnect module 14 of FIG. 8). The left channel signal, right channel signal, and common ground signals are fed directly to the cross-over network of integral sub-woofer unit 40.

A particular advantage of a further alternative embodiment of this invention solves the common problem of many typical consumer viewing rooms not lending themselves to easily cabling the interconnect module to the respective satellite and rear ambiance speakers. Typically, wiring home theater surround sound systems requires running cable along the walls around the sides and back of the room or drilling down through the floor and pulling cable underneath the viewing room and reentering the viewing room at the respective locations of the speakers.

Figure 12:
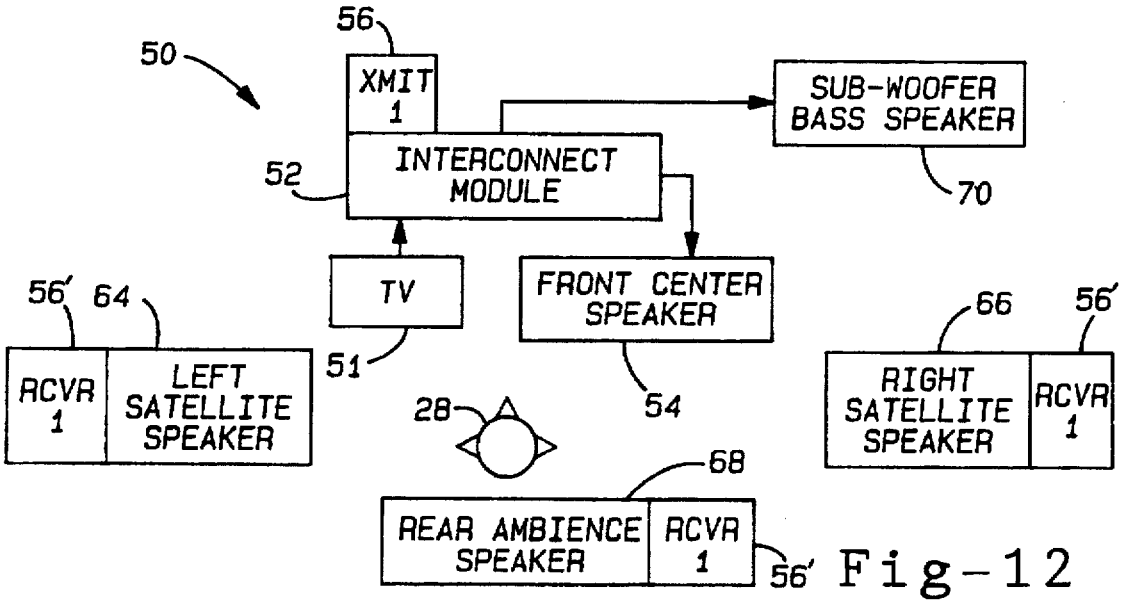
FIG. 12 is a block diagram for a wireless implementation of the home theater surround sound speaker system.

This invention lends itself particularly to a wireless home theater surround sound speaker communication system 50, as is shown in FIG. 12. A television 51 provides the left and right channels of a stereo audio signal to interconnect module 52. Interconnect module 52 distributes the left and right channel signals to the appropriate speakers in order to effect the desired system. In the embodiment shown in FIG. 12, interconnect module 52 is wired directly to television 51, front center speaker 54, and sub-woofer 70. In order to transmit the audio signals to the appropriate speakers, interconnect module 52 also includes a transmitter 56 for transmitting an audio signal to left satellite speaker 64, right satellite speaker 66, and rear ambiance speaker 68. Each of speakers 64, 66, and 68 includes a receiver 56' to receive the output signal broadcast by transmitter of interconnect module 52. Receiver 56' receives the transmitted signal and transposes the signal into an audio signal suitable for its respective speaker. It will be understood by one skilled in the art that receiver 56' may be configured to output the transposed signal to an amplifier prior to application to the speakers.

Transmitter 56 and receiver 56' preferably operate over a single channel. In order to utilize a single channel transmitter/receiver configuration, interconnect module 52 preferably outputs only one audio signal to each speaker. In order to achieve this desirable configuration, the home theater surround sound speaker system 300 of FIG. 7 would be the preferable embodiment to implement the wireless surround sound system 50 of FIG. 12. In such an embodiment, interconnect module 52 performs active signal addition and subtraction (as described with respect to FIG. 7) to generate the difference and summation signals before transmission to the respective speakers. This configuration will limit the wireless system to single channel communication, rather than multiple channel communication. Further, it will be recognized by one skilled in the art that because the left satellite speaker 320, the right satellite speaker 322, and rear speaker 318 are driven by substantially identical difference signals, interconnect module 52 can use one transmitter (56, for example) to transmit a driving audio signal to each of the speakers, thus, resulting in substantial cost savings. It will also be recognized by one skilled in the art that similarly configured receivers and transmitters could be used to wirelessly connect component speakers which have been described herein as direct wired.

From the foregoing it can be seen that this invention solves the several problems found in the prior art and satisfies the several objectives of the invention. This invention thus provides an effective, low-cost, easy to install home theater surround sound system. The front, rear, left, right, and bass speakers provide the desired sound outputs in response to application of the appropriate summation and difference signals resulting form the combination of the left and right channel signals of a stereo signal. The summation and difference signal provide the desired dialog and ambiance audio at the appropriate speaker.

Although the invention has been described with particular reference to certain preferred embodiments thereof, variations and modifications can be effected within the spirit and scope of the following claims.

What is claimed is:

1. A speaker system for reproducing a stereophonic audio signal generated by an audio signal source, comprising:

a front speaker for providing an acoustic output in response to a (L+R) input signal, where L is a left channel signal of the stereophonic signal and R is a right channel signal of the stereophonic audio signal;

a rear speaker for providing an acoustic output in response to an input signal varying defined as a difference between the left and right channel signals;

means for filtering the left channel signal to substantially eliminate low and midrange acoustic frequencies;

a left satellite speaker for providing an acoustic output substantially only in response to the filtered left channel signal;

means for filtering the right channel signal to substantially eliminate low and midrange acoustic frequencies;

a right satellite speaker for providing an acoustic output substantially only in response to the filtered right channel signal; and a bass speaker for providing low frequency acoustic output in response to at least one of the group of the L and R input signals.

2. The apparatus as defined in claim 1 further comprising an interconnect module for receiving the left and right channel signals from the audio signal source and distributing the left and right channel signals to the speakers in a predefined manner.

3. The apparatus as defined in claim 2 wherein the interconnect module further comprises:

an input connector for engaging a corresponding connector of an input cable for providing the stereophonic audio signal from the audio signal source;

a plurality of first output connectors for engaging a corresponding plurality of connectors of a plurality output cables for providing an audio signal to each of the bass and center speakers; and a plurality of second output connectors for engaging a corresponding plurality of connectors of a plurality of output cables for providing an audio signal to each of the left, right, and center speakers, the input connector and the first and second output connectors differing to insure proper connection by an operator of the input and output cables to the interconnect module.

4. The apparatus as defined in claim 3 wherein the interconnect module and the bass speaker are integrated to define one component housing both the bass speaker and the interconnect module.

5. The apparatus as defined in claim 1 further comprising an amplifier for receiving and amplifying the left and right channel signals prior to application to the respective speakers.

6. The apparatus as defined in claim 1 wherein the means for filtering input to the left and right satellite speakers are substantially identical and further comprise first order filters.

7. The apparatus as defined in claim 1 wherein the means for filtering input to the left and right satellite speakers are substantially identical and further comprise second order filters.

8. The apparatus as defined in claim 1 wherein the center speaker further comprises:

a transducer for providing acoustic output from the center speaker, the transducer having first and second voice coils, the first voice coil being responsive to the left channel signal, and the second voice coil responsive to the right channel signal;

wherein the acoustic output of the transducer provides a resultant (L+R) audio signal.

9. The apparatus as defined in claim 1 wherein the center speaker further comprises:

a first transducer for providing acoustic output from the center speaker, the first transducer having a first voice coil responsive to the left channel signal; and a second transducer for providing acoustic output from the center speaker, the second transducer having a second voice coil responsive to the right channel signal;

wherein the acoustic output of the first and second transducers substantially combined to provide a resultant (L+R) audio signal.

10. The apparatus as defined in claim 1 wherein the rear speaker further comprises:

a transducer for providing acoustic output from the rear speaker, the transducer having a voice coil including a first, positive terminal to which is applied the left channel signal and a second, negative terminal to which is applied the right channel signal;

wherein the acoustic output of the transducer provides a resultant (L−R) audio signal.

11. The apparatus as defined in claim 1 wherein the rear speaker further comprises:

a transducer for providing acoustic output from the rear speaker, the transducer having a first voice coil responsive to a first channel signal and a second voice coil responsive to a second channel signal, the second voice coil having the second channel signal applied thereto in a polarity opposite the polarity of the first channel signal applied to the first voice coil;

wherein the transducer provides an acoustical output signal varying in accordance with a difference between the first and second signal.

12. The apparatus as defined in claim 1 wherein the left satellite speaker provides an acoustic output in response to a first difference signal defined in accordance with a difference between the left and right channel signals and the right satellite speaker provides an acoustic output in response to a difference signal defined in accordance with a second difference signal defined in accordance with a difference between the left and right channel signals.

13. The apparatus as defined in claim 12 wherein the first and second difference signals are substantially identical and the difference signal is defined as one of (L−R) and (R−L) signals.

14. The apparatus as defined in claim 12 wherein one of the difference signals is defined as a (L−R) signal and the other difference signal is defined as a (R−L) signal.

15. The apparatus as defined in claim 12 further comprising:

a left high pass filter for passing to the left satellite speaker substantially only high audio frequencies of the first difference signal; and a right high pass filter for passing to the right satellite speaker substantially only high audio frequencies of the second difference signal.

16. The apparatus as defined in claim 15 wherein the left and right high pass filters are substantially identical and further comprise a capacitor in series with a positive input terminal of the audio signal applied to the satellite speaker.

17. The apparatus as defined in claim 15 wherein the left and right high pass filters are substantially identical and further comprise:

a capacitor in series with the positive terminal of each satellite speaker; and an inductor in shunt across the positive and negative terminals of each satellite speaker.

18. The apparatus as defined in claim 1 wherein the means for filtering the left channel signal eliminates acoustic frequencies below 1 kilohertz (KHz), and the means for filtering the right channel signal eliminates acoustic frequencies below 1 kilohertz (KHz).

19. A speaker system for reproducing a stereophonic audio signal generated by an audio signal source and associated with a companion video signal, comprising:

a signal preprocessor for generating summation and difference ((R−L) or (L−R)) output signals based upon a L and R input signal, where L is a left channel signal of the stereophonic signal and R is a right channel signal of the stereophonic audio signal;

a first speaker for providing an acoustic output in response to the summation output signal;

first means for filtering the difference signal to substantially eliminate low and midrange acoustic frequencies;

a second speaker for providing an acoustic output substantially only in response to the first filtered difference signal;

second means for filtering the difference signal to substantially eliminate low and midrange acoustic frequencies;

a third speaker for providing an acoustic output substantially only in response to the second filtered difference signal; and a fourth speaker for providing an acoustic output in response to the difference output signal.

20. The apparatus as defined in claim 19 further comprising a fifth speaker for providing low frequency acoustic output in response to the summation output signal.

21. The apparatus as defined in claim 19 further comprising an amplifier for receiving and amplifying the left and right channel signals prior to application to the respective speakers.

22. The apparatus as defined in claim 19 wherein the first and second means for filtering are substantially identical and further comprise a first order filter.

23. The apparatus as defined in claim 19 wherein the first and second means for filtering are substantially identical and further comprise a second order filter.

24. The apparatus as defined in claim 19 wherein the preprocessor outputs an (L–R) difference signal input to he second, third, and fourth speakers.

25. The apparatus as defined in claim 19 wherein the preprocessor outputs an (L–R) difference signal input to one of the second and third speakers and to the fourth speaker, and the difference signal is applied to the other of the second and third speakers with a reverse polarity.

26. The apparatus as defined in claim 19 wherein the preprocessor outputs an (R–L) difference signal input to one of the second and third speakers and to the fourth speaker, and the difference signal is applied to the other of the second and third speakers with a reverse polarity.

27. The apparatus as defined in claim 19 wherein the preprocessor outputs an (L+R) summation signal input to the first speaker.

28. The apparatus as defined in claim 19 wherein the first means for filtering the left channel signal eliminates acoustic frequencies below 1 kilohertz (KHz), and the second means for filtering the right channel signal eliminates acoustic frequencies below 1 kilohertz (KHz).

29. A speaker system for reproducing a stereophonic audio signal having component left and right channel input signals, comprising:

a front speaker for providing an acoustic output in response to a (L+R) summation signal, where L is a left channel signal of the stereophonic signal and R is a right channel signal of the stereophonic signal;

a pair of side speakers for providing acoustic output in response to the component input signals, where the component input signals are filtered prior to application to the side speakers so that substantially only high frequency portions of the component input signals are output by the side speakers;

a rear speaker for providing acoustic output in response to a (L–R) difference signal of the component input signals;

a wireless interconnect module for receiving the left and right channel signals and wirelessly distributing selected combinations of the left and right signals to particular speakers, the wireless interconnect module including at least one transmitter for transmitting a selected combination of the output signals to the respective speakers; and a receiver associated with a particular speaker for receiving the transmitted signal from the at least one transmitter, the receiver receiving the transmitted signal and outputting an electronic signal input to the speaker.

30. The apparatus as defined in claim 29 further comprising a fifth speaker for providing low frequency acoustic output in response to a summation signal of the component input signals.

31. The apparatus as defined in claim 30 wherein the fifth speaker is responsive to a summation (L+R) input signal, where L is a left channel signal of the stereophonic signal and R is a right channel signal of the stereophonic audio signal.

32. The apparatus as defined in claim 29 wherein the pair of side speakers is responsive to a (L–R) difference signal ((R–L) or (L–R)), where L is a left channel signal of the stereophonic signal and R is a right channel signal of the stereophonic audio signal.

33. The apparatus as defined in claim 32 wherein the rear speaker is responsive to the difference signal.

34. The apparatus as defined in claim 29 wherein the front speaker is responsive to a summation (L+R) input signal, where L is a left channel signal of the stereophonic signal and R is a right channel signal of the stereophonic audio signal.

35. The apparatus as defined in claim 29 wherein the side speakers are filtered to substantially eliminate frequencies below 1 kilohertz (KHz).

* * * * *

UNITED STATES PATENT AND TRADEMARK OFFICE

CERTIFICATE OF CORRECTION

PATENT NO. : 5,708,719

DATED : January 13, 1998

INVENTOR(S) : Hal P. Greenberger, William F. Clack and Jerome E. Ruzicka

It is certified that error appears in the above-identified patent and that said Letters Patent is hereby corrected as shown below:

ON THE TITLE PAGE, under U.S. Patent Documents, reference 4,086,433, "Gerzo" should be --Gerzon--.

ON THE TITLE PAGE, under U.S. Patent Documents, reference "4,135,975" should be --4,133,975--.

Column 14, line 15, "highpass" should be --high pass--.

Column 16, line 31, "highpass" should be --high pass--.

Column 18, line 46, "(L - R)" should be --(L + R)--.

Column 19, line 12, "highpass" should be --high pass--.

Column 25, line 12, Claim 24, "he" should be --the--.

Signed and Sealed this

Twenty-fourth Day of November, 1998

Bruce Lehman

*Attest:*

BRUCE LEHMAN

*Attesting Officer*

*Commissioner of Patents and Trademarks*